US008141944B2

(12) United States Patent
Reeb et al.

(10) Patent No.: US 8,141,944 B2
(45) Date of Patent: Mar. 27, 2012

(54) COLLAPSIBLE CHAIR HAVING REDUCED LINKAGES

(75) Inventors: David Reeb, Sykesville, MD (US); Paul Robinette, Canal Winchester, OH (US)

(73) Assignee: Swimways Corporation, Virginia Beach, VA (US)

( * ) Notice: Subject to any disclaimer, the term of this patent is extended or adjusted under 35 U.S.C. 154(b) by 93 days.

(21) Appl. No.: 12/605,876

(22) Filed: Oct. 26, 2009

(65) Prior Publication Data

US 2011/0095576 A1 Apr. 28, 2011

(51) Int. Cl.
*A47C 4/28* (2006.01)

(52) U.S. Cl. ..... 297/45; 297/16.2

(58) Field of Classification Search ..... 297/16.2, 297/45

See application file for complete search history.

(56) References Cited

U.S. PATENT DOCUMENTS

| | | | | | |
|---|---|---|---|---|---|
| 101,999 | A | | 4/1870 | Haines | |
| 115,598 | A | | 6/1871 | Free | |
| 180,610 | A | | 8/1876 | Lungren | |
| 615,476 | A | | 12/1898 | Chapman | |
| 647,171 | A | | 4/1900 | Wiles | |
| 1,422,319 | A | | 7/1922 | Stoll | |
| 1,481,521 | A | | 1/1924 | Marsh | |
| 2,542,040 | A | | 2/1951 | MacLellan | |
| 3,838,883 | A | * | 10/1974 | Machen | 297/16.2 |
| 4,124,188 | A | * | 11/1978 | Machen | 297/45 X |
| 4,184,711 | A | | 1/1980 | Wakimoto | |
| 4,251,106 | A | | 2/1981 | Gilbert | |
| 4,266,748 | A | | 5/1981 | Dalton | |
| 4,547,015 | A | * | 10/1985 | Wakimoto | 297/16.2 |
| 4,585,270 | A | | 4/1986 | Singer | |
| 4,652,047 | A | | 3/1987 | Chan | |
| 4,810,029 | A | * | 3/1989 | Kaladis et al. | 297/16.2 |
| 5,494,333 | A | | 2/1996 | Wilson | |
| 5,522,642 | A | | 6/1996 | Herzog | |
| 5,876,091 | A | | 3/1999 | Chernomashentsev | |
| 5,921,621 | A | | 7/1999 | Cook et al. | |
| 5,975,626 | A | | 11/1999 | Aycock | |
| 5,984,406 | A | | 11/1999 | Lee | |
| 6,270,156 | B1 | | 8/2001 | Metzger et al. | |
| 6,454,348 | B1 | * | 9/2002 | Wu | 297/16.2 |
| 6,499,804 | B1 | | 12/2002 | Wu | |

(Continued)

OTHER PUBLICATIONS

International Search Report and Written Opinion for International Patent Application No. PCT/US10/53941, mailed on Dec. 23, 2010; 11 pages.

*Primary Examiner* — Rodney B White
(74) *Attorney, Agent, or Firm* — Cooley LLP

(57) ABSTRACT

An apparatus includes a seat frame having an expanded configuration and a collapsed configuration. The seat frame includes a support member and four elongate members. A first elongate member is of a first pole type, a second elongate member is of a second pole type, and a third and fourth elongate member are of a third pole type defined by a length and a shape. Each of the elongate members are pivotably connected to the support member. When the seat frame is in the expanded configuration, the first and second elongate members have a first end disposed at a front portion of the seat frame and a second end disposed at a back portion of the seat frame; and the third and the fourth elongate member have a first end disposed at the back portion of the frame and a second end disposed at the front portion of the frame.

23 Claims, 17 Drawing Sheets

U.S. PATENT DOCUMENTS 6,547,321 B2 4/2003 Wu
6,634,704 B1 * 10/2003 Bergquist ..... 297/16.2
6,644,731 B2 11/2003 Tang
6,682,135 B2 1/2004 Zheng
6,817,671 B1 11/2004 Zheng
6,824,208 B2 11/2004 Zheng
6,840,574 B1 1/2005 Wu
6,899,383 B2 5/2005 Hwang
7,198,324 B2 4/2007 Le Gette et al.
7,328,940 B2 2/2008 Zheng
7,380,879 B2 6/2008 Fletcher et al.
7,396,073 B2 7/2008 Zheng
2002/0117878 A1 8/2002 Fox
2008/0231088 A1 9/2008 Zheng
2009/0174233 A1 * 7/2009 Hoffman et al. ..... 297/16.2

* cited by examiner

COLLAPSIBLE CHAIR HAVING REDUCED LINKAGES

BACKGROUND

The invention relates generally to a collapsible chair, and more particularly to, a collapsible chair having reduced linkages.

Known collapsible chairs include elongate members that are entirely disposed at or near the front portion of the chair and other elongate members that are entirely disposed at or near the back portion of the chair. Such collapsible chairs are often cumbersome to expand and collapse. Additionally, manufacturing such collapsible chairs require numerous connections and coupling members resulting in increased manufacturing time and expenses.

Moreover, known collapsible chairs are assembled using many different types of elongate members. For example, some known collapsible chairs can be assembled using four or more different types of elongate members. As the number of elongate member types increase, the cost to manufacture and assemble them also increases.

Thus, a need exists for an improved collapsible chair that has reduced connections and/or coupling members. A need also exists for an improved collapsible chair that has reduced types of components.

SUMMARY

An apparatus includes a seat frame having an expanded configuration and a collapsed configuration. The seat frame includes a support member and four elongate members. A first elongate member is of a first pole type, a second elongate member is of a second pole type, and a third and fourth elongate member are of a third pole type defined by a length and a shape. Each of the elongate members are pivotably connected to the support member. When the seat frame is in the expanded configuration, the first and second elongate members have a first end disposed at a front portion of the seat frame and a second end disposed at a back portion of the seat frame; and the third and the fourth elongate member have a first end disposed at the back portion of the frame and a second end disposed at the front portion of the frame.

DETAILED DESCRIPTION

Figure 1:
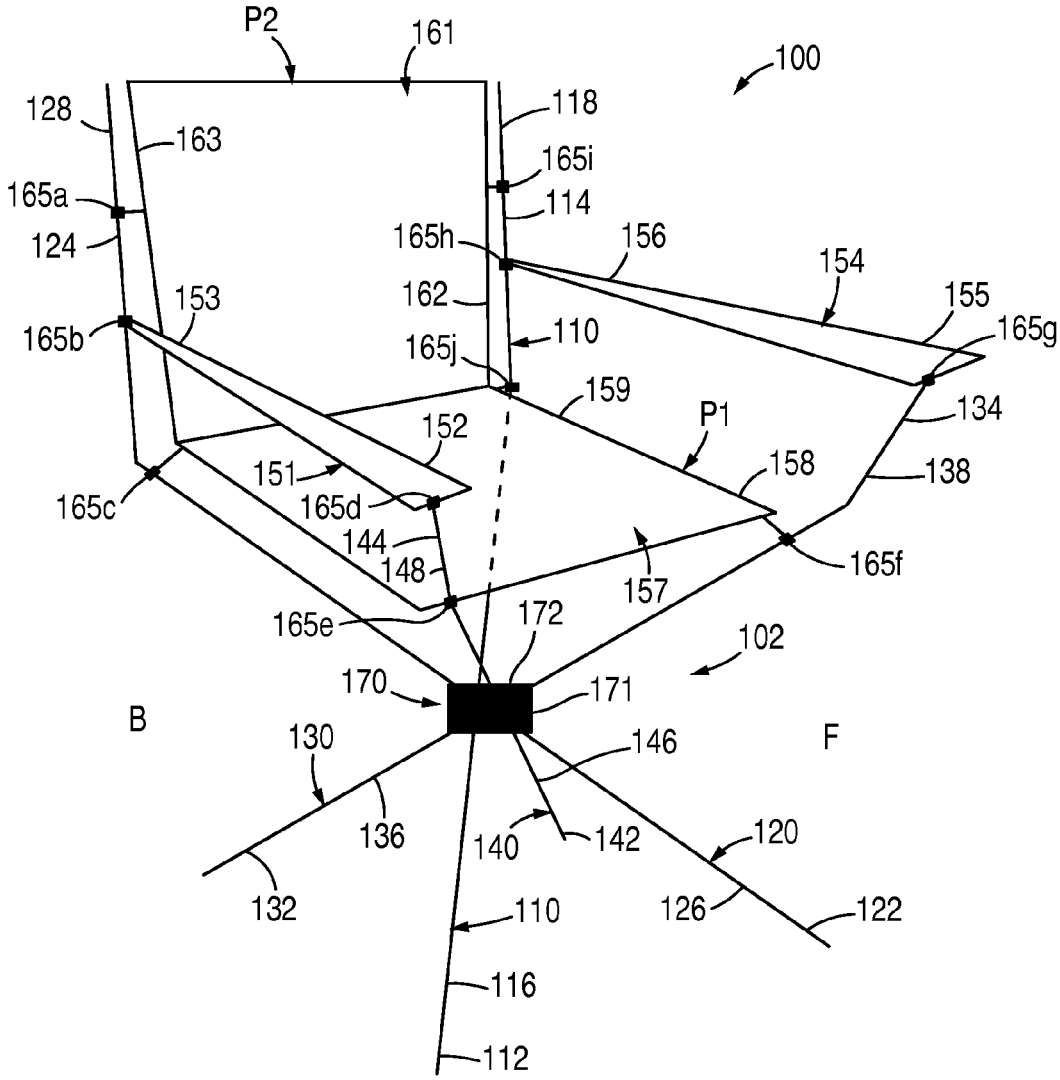
FIGS. 1 and 2 are schematic illustrations of a collapsible chair according to an embodiment in an expanded configuration and a collapsed configuration with a portion of the chair being enclosed by a cover, respectively.

Apparatus for a collapsible chair having reduced linkages are described herein. In one embodiment, an apparatus includes a seat frame having an expanded configuration and a collapsed configuration. The seat frame includes a support member, a first elongate member, a second elongate member, a third elongate member and a fourth elongate member. The first elongate member, which is of a first pole type defined by a length and a shape, and the second elongate member, which is of a second pole type defined by a length and a shape, are each pivotably connected to the support member. The first elongate member and the second elongate member each have a first end disposed at a front portion of the seat frame and a second end disposed at a back portion of the seat frame when the seat frame is in the expanded configuration. The third elongate member and the fourth elongate member, which are of a third pole type defined by a length and a shape, are pivotably connected to the support member. The third elongate member and the fourth elongate member each have a first end disposed at the back portion of the frame and a second end disposed at the front portion of the frame when the frame is in the expanded configuration.

In some embodiments, an apparatus includes a membrane and a seat frame that has an expanded configuration and a collapsed configuration. The seat frame includes a support member, a first elongate member and a second elongate member. The first elongate member and the second elongate member are each pivotably connected to the support member. Additionally, the first elongate member and the second elongate member each have a first end disposed at a front portion of the seat frame and each also have a second end disposed at a back portion of the seat frame when the seat frame is in the expanded configuration. In some embodiments, the seat frame can extend through an opening defined by the membrane. The membrane has a first portion and a second portion. In some embodiments, the first portion of the membrane can be disposed about the support member and/or fixedly coupled to the support member. The second portion of the membrane is moveable between a first position and a second position. When the second portion is in the first position, the seat frame is in the expanded configuration and the second portion is disposed about at least a portion of the support member. When the second portion is in the second position, the seat frame is in the collapsed configuration and the second portion is configured to retain at least a portion of the seat frame. In some embodiments, the second portion of the membrane includes a drawstring or other like fastener configured to close an opening of the membrane.

In other embodiments, an apparatus includes a first membrane, a second membrane and a seat frame that has an expanded configuration and a collapsed configuration. The seat frame includes a support member, a first elongate member, a second elongate member, a third elongate member and a fourth elongate member. The first elongate member and the second elongate member are each pivotably connected to the support member. Additionally, the first elongate member and the second elongate member each have a first portion disposed at a front portion of the seat frame and each also have a second portion disposed at a back portion of the seat frame when the seat frame is in the expanded configuration. Similarly, the third elongate member and the fourth elongate member are pivotably connected to the support member. The third elongate member and the fourth elongate member each have a first portion disposed at the back portion of the seat frame and each also have a second portion disposed at the front portion of the seat frame when the seat frame is in the expanded configuration. The first membrane is coupled to the second portion of the first elongate member and the second portion of the third elongate member, thereby defining a first arm support. Likewise, the second membrane is coupled to the second portion of the second elongate member and the second portion of the fourth elongate member, thereby defining a second arm support. In some such embodiments, the first membrane and the second membrane are configured to limit an outward expansion of the seat frame when the seat frame is in the expanded configuration. In other embodiments, the apparatus can further include a third membrane, which extends from the second portion of the first elongate member to the second portion of the second elongate member. The third membrane can define a back support and be configured to limit the outward expansion of the seat frame when the seat frame is in the expanded configuration.

The term "membrane" is used herein to include, but is not limited to, a layer of material. For example, the membrane can be a piece of fabric such as terry cloth, nylon or neoprene. Alternatively, the membrane can be a layer of material other than fabric, such as a layer of polyvinyl chloride (PVC). In some embodiments, one membrane (e.g., the third membrane which defines the back support) can be a machine-washable fabric such as terry cloth; another membrane (e.g., the first membrane which defines the first arm support) can be a fabric, not necessarily machine washable, such as nylon.

Figure 2:
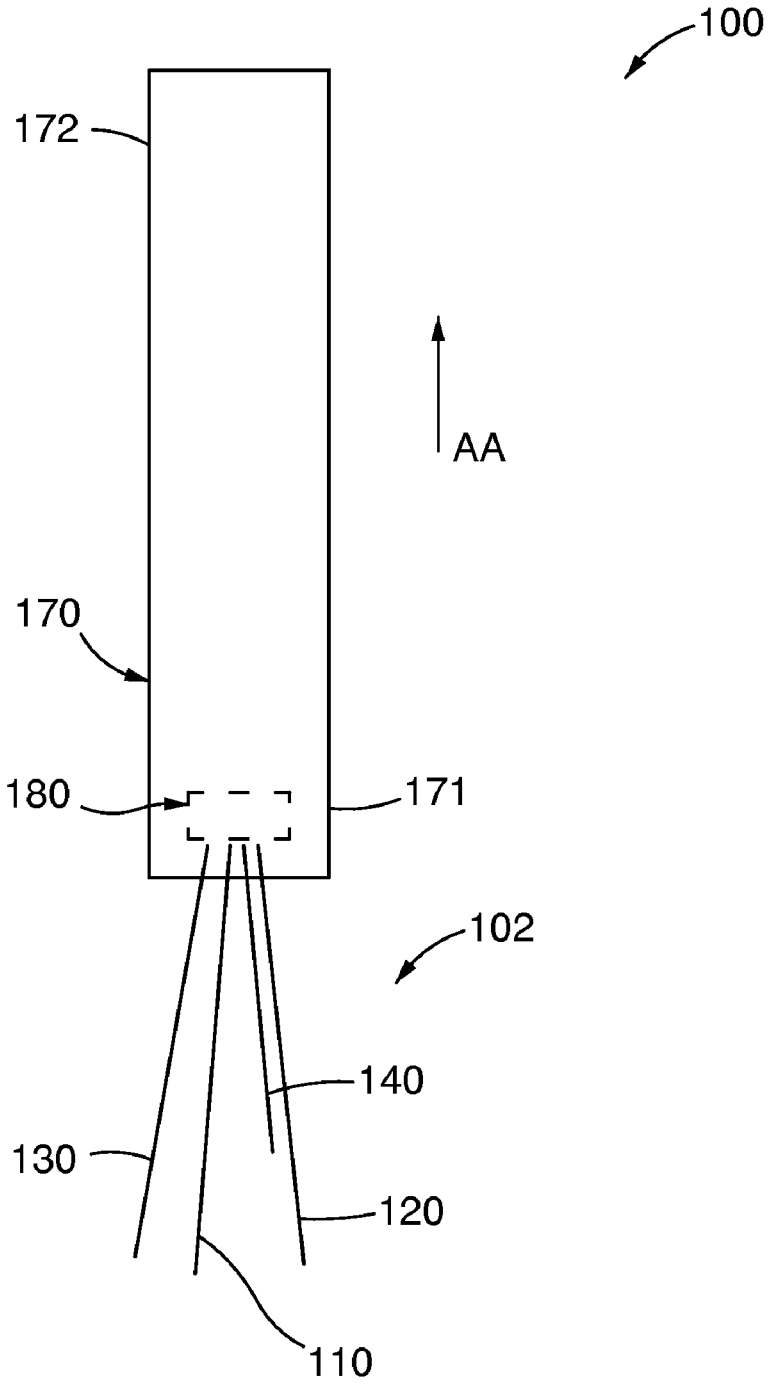

FIGS. 1 and 2 are schematic illustrations of a collapsible chair 100 in an expanded configuration and a collapsed configuration with a portion of the chair 100 being enclosed by a cover 170, respectively. When the collapsible chair 100 is in the expanded configuration (FIG. 1), the chair 100 has a front portion F and a back portion B. The collapsible chair 100 includes a seat frame 102, a first membrane 151, a second membrane 154, a third membrane 157, a fourth membrane 161 and the cover 170. The seat frame 102 is configured to move between the expanded configuration and the collapsed configuration such that the chair 100 moves between the expanded configuration and the collapsed configuration. As such, the terms "expanded configuration" and "collapsed configuration" can be used in reference to the chair 100 and the seat frame 102. The seat frame 102 is configured to support the weight of a user seated in the chair 100 when the seat frame 102 is in the expanded configuration. When the seat frame 102 is in the collapsed configuration, the chair 100 can be easily stored or transported. The seat frame 102 can be moved from the expanded configuration to the collapsed configuration by folding the seat frame 102 together, as described in more detail herein.

The seat frame 102 includes a support member 180 (shown in phantom in FIG. 2), a first elongate member 110, a second elongate member 120, a third elongate member 130, and a fourth elongate member 140. Each of the elongate members 110, 120, 130 and 140 have a first portion 116, 126, 136, 146 and a second portion 114, 124, 134, 144, respectively. The first portions 116, 126, 136, 146 function as legs of the chair 100 when the seat frame 102 is in the expanded configuration. A first end 112, 122, 132, 142 of each of the first portions 116, 126, 136, 146 is configured to contact a ground surface and, thereby, provide stability and balance the seat frame 102 when the seat frame 102 is in the expanded configuration. In some embodiments, the first end 112, 122, 132, 142 of each of the first portions 116, 126, 136, 146 include openings (not shown) such that loose material, such as sand or dirt, can pass through the openings when the first end 112, 122, 132, 142 of each of the first portions 116, 126, 136, 146 are placed on a surface with such loose material. In some embodiments, the first end 112, 122, 132, 142 of one or more of the first portions 116, 126, 136, 146 can be coupled to a foot member such that the foot member contacts the surface and provides stability to the seat frame 102 when the seat frame 102 is in the expanded configuration, as discussed in more detail herein.

The second portions 114, 124, 134, 144 are defined by the portions of the elongate members 110, 120, 130 and 140 that are angled relative to the first portions 116, 126, 136, 146. The second portion 114 of the first elongate member 110 and the second portion 124 of the second elongate member 120 each functions to support a portion of an armrest, as described below. The second portion 134 of the third elongate member 130 and the second portion 144 of the fourth elongate member 140 each functions to support a portion of an armrest and collectively function to support a portion of a backrest, as described below. A second end 118, 128, 138, 148 is disposed in each of the second portions 114, 124, 134, 144. In some embodiments, the second end 118, 128, 138, 148 is configured to support a portion of an armrest and/or backrest.

In some embodiments, the first portion 116, 126, 136 and/or 146 and the second portion 114, 124, 134 and/or 144 are coupled together to form the elongate members 110, 120, 130 and/or 140, respectively. In some embodiments, the elongate members 110, 120, 130 and/or 140 are monolithically constructed. In alternative embodiments, the first portion 116, 126, 136 and/or 146 and the second portion 114, 124, 134 and/or 144, respectively, can be coupled together by any suitable means. For example, the first portion 116, 126, 136 and/or 146 and the second portion 114, 124, 134 and/or 144, respectively, can be coupled together by a mechanical coupling (e.g., an interference fit, detents, a threaded coupling, or the like), an electronic coupling (e.g., a magnetic coupling), a chemical bond, a hydraulic coupling and/or a pneumatic coupling (e.g., a vacuum coupling).

The elongate members 110, 120, 130 and/or 140 can be formed of any material and configured in any cross-sectional shape that provides sufficient structural strength to support a user. For example, the elongate members 110, 120, 130 and/or 140 can be aluminum tubes or poles, plastic tubes or poles, solid metal or plastic bars, and/or the like. In some embodiments, the elongate members 110, 120, 130 and/or 140 can be hollow, metal tubes or poles, such as steel tubes or poles.

As shown in FIG. 1, the seat frame 102 is constructed from two different types of elongate member structures. For example, the first elongate member 110 and the second elongate member 120 are of a first structure type. More specifically, the first elongate member 110 and the second elongate member 120 have substantially the same shape and size. In some embodiments, the first elongate member 110 and the second elongate member 120 can further be constructed of the same material(s). Similarly, the third elongate member 130 and the fourth elongate member 140 are of a second structure type. More specifically, the third elongate member 130 and the fourth elongate member 140 have substantially the same shape and size. In some embodiments, the third elongate member 130 and the fourth elongate member 140 can further be constructed of the same material(s). In some embodiments, the seat frame 102 can be constructed from any number of different types of elongate member structures. For example, the seat frame 102 can be constructed from three different types of elongate member structures.

The support member 180 is coupled, respectively, to the first portion 116, 126, 136 and 146 of each elongate member 110, 120, 130 and 140 in a manner that allows the elongate members 110, 120, 130 and 140 to move the seat frame 102 between the expanded configuration and the collapsed configuration. For example, as shown in FIGS. 1 and 2, each first portion 116, 126, 136 and 146 is pivotably connected to the support member 180. As a result of the pivotable connection, each first portion 116, 126, 136 and 146 can rotate or pivot about the support member 180 to move the elongate members 110. 120, 130 and 140 (and thus the seat frame 102) between configurations. In other embodiments, the first portions 116, 126, 136 and 146 and the support member 180 can be coupled together by any suitable means, such as a mechanical coupling.

The support member 180, which has a substantially rectangular cuboid shape, provides a common location or hub where the elongate members 110, 120, 130 and 140 converge along the same axis, as described in more detail herein. Such a common location or hub allows each of the elongate members 110, 120, 130 and 140 to expand outwardly relative to one another to expand the seat frame 102. The common location or hub also allows each of the elongate members 110, 120, 130 and 140 to contract inwardly relative to one another to collapse the seat frame 102, as will be described in more detail herein. Further, the common location or hub results in the seat frame 102 having a constant perimeter or cross-sectional size and/or shape about the support member 180 as the seat frame 102 moves between the expanded configuration and the collapsed configuration. The support member 180 can have any suitable shape that facilitates the movement of the elongate members 110, 120, 130 and 140 between the collapsed configuration and the expanded configuration. For example, in some embodiments, the support member 180 can have a cubic shape. In other embodiments, the support member 180 can be an elongate member having a tubular shape. Additionally, the support member 180 can be constructed of any suitable material such as wood, metal, steel, plastic and/or the like. The support member 180 can be hollow and/or solid.

The first membrane 151 is disposed between the second elongate member 120 and the fourth elongate member 140 and forms a right armrest when the seat frame 102 is in the expanded configuration. The first membrane 151, which has a substantially rectangular shape, includes a first portion 152 and a second portion 153. The first portion 152 of the first membrane 151 is coupled to the second portion 144 of the fourth elongate member 140 via coupling member 165*d*. Although FIG. 1 illustrates the first portion 152 of the first membrane 151 being coupled to a distal-most end of the second portion 144 of the fourth elongate member 140, in other embodiments, the first portion 152 of the first membrane 151 can be coupled to the fourth elongate member 140 at any suitable location. The second portion 153 of the first membrane 151 is coupled to the second portion 124 of the second elongate member 120 via coupling member 165*b*. In some embodiments, however, the second portion 153 of the first membrane 151 can be coupled to the second elongate member 120 at any suitable location. As shown in FIG. 1, when the first membrane 151 is extended between the second elongate member 120 and the forth elongate member 140, the first membrane 151 is substantially taut and positioned substantially parallel to the surface on which the expanded seat frame 102 is disposed. In some embodiments, the first membrane 151 can be positioned at any angle relative to the surface. Additionally, the first membrane 151 can have any suitable shape and/or size configured to support a right arm of the user.

The second membrane 154 is disposed between the third elongate member 130 and the first elongate member 110 and forms a left armrest when the seat frame 102 is in the expanded configuration. The second membrane 154, which also has a substantially rectangular shape, includes a first portion 155 and a second portion 156. The first portion 155 of the second membrane 154 is coupled to the second portion 134 of the third elongate member 130 via coupling member 165*g*. Although FIG. 1 illustrates the first portion 155 of the second membrane 154 being coupled to a distal-most end of the second portion 134 of the third elongate member 130, in other embodiments, the first portion 155 of the second membrane 154 can be coupled to the third elongate member 130 at any suitable location. The second portion 156 of the second membrane 154 is coupled to the second portion 114 of the first elongate member 110 via coupling member 165*h*. In some embodiments, however, the second portion 156 of the second membrane 154 can be coupled to the first elongate member 110 at any suitable location. Similar to the first membrane 151, when the second membrane 154 is extended between the third elongate member 130 and the first elongate member 110, the second membrane 154 is substantially taut and positioned substantially parallel to the surface on which the expanded seat frame 102 is disposed. In some embodiments, the second membrane 154 can be positioned at any angle relative to the surface. Additionally, the second membrane 154 can have any suitable shape and/or size configured to support a left arm of the user.

The third membrane 157 is disposed between each of the elongate members 110, 120, 130 and 140 and forms a seat when the seat frame 102 is in the expanded configuration. The third membrane 157 includes a first portion 158 and a second portion 159. The first portion 158 of the third membrane 157 is coupled to the first portion 136 of the third elongate member 130 and to the first portion 146 of the fourth elongate member 140 via coupling members 165*f* and 165*e*, respectively. More specifically, the first portion 158 of the third membrane 157 is coupled to the first portion 136 of the third elongate member 130 at a location proximate the second portion 134 of the third elongate member 130. Likewise, the first portion 158 of the third membrane 157 is coupled to the first portion 146 of the fourth elongate member 140 at a location proximate the second portion 144 of the fourth elongate member 140. In some embodiments, the first portion 158 can be coupled to the second portion 134 of the third elongate member 130 and/or to the second portion 144 of the fourth elongate member 140. The second portion 159 of the third membrane 157 is coupled to the first portion 126 of the second elongate member 120 and to the first portion 116 of the first elongate member 110 via coupling members 165*c* and 165*j*, respectively. More specifically, the second portion 159 of the third membrane 157 is coupled to the first portion 126 of the second elongate member 120 at a location proximate the second portion 124 of the second elongate member 120.

Likewise, the second portion 159 of the third membrane 157 is coupled to the first portion 116 of the first elongate member 110 at a location proximate the second portion 114 of the first elongate member 110. In some embodiments, the second portion 159 can be coupled to the second portion 124 of the second elongate member 120 and/or to the second portion 114 of the first elongate member 110. As shown in FIG. 1, when the third membrane 157 is extended between the elongate members 110, 120, 130 and 140, the third membrane 157 is substantially taut and positioned substantially parallel to the surface on which the expanded seat frame 102 is disposed. In some embodiments, the third membrane 157 can be positioned at any angle relative to the surface. Additionally, the third membrane 157 can have any suitable shape and/or size configured to support the weight of the user.

As shown in FIG. 1, when the seat frame 102 is in the expanded configuration, the third membrane 157 has a perimeter, P1, that is smaller than the perimeter defined by the second portions 114, 124, 134, and 144 of the elongate members 110, 120, 130 and 140. In some embodiments, the perimeter P1 of the third membrane 157 is smaller than the perimeter defined by at least the first portion 116, 126, 136, 146 of each elongate member 110, 120, 130 and 140. The perimeter P1 of the third membrane 157 is smaller than known chair membranes that use grommets to couple the membranes to elongate members of the chair. However, the perimeter P1 of the third membrane 157, as shown in FIG. 1, involves the use of other coupling means to couple the third membrane 157 to each of the elongate members 110, 120, 130 and 140. In other embodiments, the perimeter P1 of the third membrane 157 is sufficiently larger than the perimeter defined by the second portions 114, 124, 134, and 144 of the elongate members 110, 120, 130 and 140 such that grommets can be used to couple the third membrane 157 to each of the elongate members 110, 120, 130 and 140.

The fourth membrane 161 is disposed between the first elongate member 110 and the second elongate member 120 and forms a backrest when the seat frame 102 is in the expanded configuration. The fourth membrane 161 includes a first portion 162 and a second portion 163. The first portion 162 of the fourth membrane 161 is coupled to the second portion 114 of the first elongate member 110 via coupling member 165*i*. The second portion 163 of the fourth membrane is coupled to the second portion 124 of the second elongate member 120 via coupling member 165*a*. When the fourth membrane 161 is extended between the first elongate member 110 and the second elongate member 120, the fourth membrane 161 is substantially taut and positioned substantially perpendicular to the surface on which the expanded seat frame 102 is disposed. In some embodiments, the fourth membrane 161 can be positioned at any angle relative to the surface. Additionally, the fourth membrane 161 can have any suitable shape and/or size configured to support the weight of the user.

The fourth membrane 161 is coupled to the second portion 159 of the third membrane 157. In this manner, the fourth membrane 161 is substantially taut when the seat frame 102 is in the expanded configuration due to the outward force produced by the coupling members 165*a* and 165*i* and the downward force produced by the third membrane 157. The fourth membrane 161 and the third membrane 157 can be coupled by any suitable means, such as a mechanical fastener, an adhesive fastener and/or the like. In some embodiments, for example, the fourth membrane 161 and the third membrane 157 can be sewn together. In other embodiments, the fourth membrane 161 and the third membrane 157 can be monolithically constructed. In yet other embodiments, the fourth membrane 161 can be separate from the third membrane 157. In some such embodiments, additional coupling members may be needed to couple the fourth membrane 161 to the first elongate member 110 and the second elongate member 120.

As shown in FIG. 1, the fourth membrane 161 has a perimeter, P2, that is smaller than the perimeter defined by the second portion 114 of the first elongate member 110 and the second portion 124 of the second elongate member 120 when the seat frame 102 is in the expanded configuration. The perimeter P2 of the fourth membrane 161 is smaller than known chair membranes that use grommets to couple the membranes to elongate members of the chair, as described above. Similar to the third membrane 157, the perimeter P2 of the fourth membrane 161 involves the use of other coupling means to couple the fourth membrane 161 to the first elongate member 110 and the second elongate member 120. In some embodiments, however, the perimeter P2 of the fourth membrane 161 is sufficiently larger than the perimeter defined by the second portion 114 of the first elongate member 110 and the second portion 124 of the second elongate member 120 such that grommets can be used to couple the fourth membrane 161 to the first elongate member 110 and the second elongate member 120.

The coupling members 165*a*, 165*b*, 165*c*, 156*d*, 165*e*, 165*f*, 165*g*, 165*h*, 165*i* and 165*j* can be any suitable coupling members, such as, a mechanical fastener, an adhesive fastener, a magnetic coupler and/or the like. For example, the coupling members 165*a*, 165*b*, 165*c*, 156*d*, 165*e*, 165*f*, 165*g*, 165*h*, 165*i* and 165*j* can include at least one of a buckle, male coupler, female coupler, clip, hook, loop fastener and/or the like. In some embodiments, the coupling members 165*a*, 165*b*, 165*c*, 156*d*, 165*e*, 165*f*, 165*g*, 165*h*, 165*i* and 165*j* can be a coiled spring.

In some embodiments, one or more of the coupling members 165*a*, 165*b*, 165*c*, 156*d*, 165*e*, 165*f*, 165*g*, 165*h*, 165*i* and 165*j* can be a webbing. The webbing can be coupled to membranes 151, 154, 157 and 161 in any suitable manner. For example, in some embodiments, the webbing (e.g., the coupling member 165*c*) can be sewn to the membrane (e.g., third membrane 157). In some embodiments, the webbing can be looped through an opening in the membrane. In other embodiments, the webbing can be coupled to another coupling member, such as a mechanical fastener, that is directly coupled to the membrane. In this manner, the webbing is indirectly coupled to the membrane via the other coupling member.

The webbing can be coupled to the elongate members 110, 120, 130 and 140 in any suitable manner. For example, in some embodiments, the webbing (e.g., the coupling member 165*c*) can be looped around the elongate member (e.g., the second elongate member 120). In some embodiments, the webbing can be coupled to the elongate member via another coupling member such as a mechanical fastener, an adhesive fastener, a hook, a clip, and/or the like. In this manner, the webbing is indirectly coupled to the elongate member via the other coupling member.

The webbing can be, for example, a nylon webbing, a polypropylene webbing, a cotton webbing, an elastic webbing and/or the like. The webbing can have any suitable shape and/or size. For example, in some embodiments, the webbing can be flat or have a substantially tubular shape. In some embodiments, one or more of the coupling members 165*a*, 165*b*, 165*c*, 156*d*, 165*e*, 165*f*, 165*g*, 165*h*, 165*i* and 165*j* can include one or more webbings.

The cover 170, which has a substantially tubular shape, is coupled to the support member 180. The cover 170 includes a first end 171 and a second end 172, and defines a lumen (not shown) therethrough. Additionally, the cover 170 defines a first opening (not shown) at the first end 171 and second opening (not shown) at the second end 172. The lumen is configured to receive a portion of the seat frame 102 via the first opening and/or the second opening. In this manner, the seat frame 102 is disposed within the lumen defined by the cover 170. The lumen, the first opening and the second opening each have a diameter that is substantially the same size as or larger than the diameter of the seat frame 102 about the support member 180.

The first end 171 of the cover 170 is disposed about and coupled to the support member 180. The first end 171 is configured to maintain the same position about the support member 180 when the seat frame 102 moves between the expanded configuration and the collapsed configuration. In some embodiments, the first end 171 can have limited movement about the support member 180 when the seat frame 102 moves between the expanded configuration and the collapsed configuration. The first end 171 can be coupled to the support member 180 by any suitable means, such as, for example, a mechanical fastener, an adhesive fastener, a magnetic coupler and/or the like. In some embodiments, the cover 170 can be removeably coupled to the support member 180; while, in other embodiments, the cover 170 can be fixedly coupled to the support member 180.

The second end 172 of the cover 170 is configured to move between a first position (FIG. 1) and a second position (FIG. 2). When the seat frame 102 is in the expanded configuration, the second end 172 of the cover 170 is in the first position. More specifically, the second end 172 of the cover 170 is disposed about the support member 180 when the second end 172 is in the first position. In this manner, the second end 172 of the cover 170 is in close proximity to the first end 172 such that the length of the cover 170 is minimized when the second end 172 is in the first position. The material between the first end 171 and the second end 172 of the cover 170 can be, for example, folded when the second end 172 is in the first position.

When the seat frame 102 is in the collapsed configuration, the second end 172 of the cover 170 can be moved from the first position to the second position. As shown in FIG. 2, the second end 172 of the cover 170 can be moved upward in direction AA over a portion of the seat frame 102. Similarly stated, the second end 172 of the cover 170 can slide over the collapsed seat frame 102 such that the material of the cover 170 is unfolded and/or lengthened. The second end 172 of the cover 170 is in the second position when the second end 172 of the cover 170 encloses the portion of the seat frame 102 disposed above the support member 180. Although FIG. 2 shows the cover 170 enclosing the entire portion of the seat frame 102 disposed above the support member 180, in some embodiments, the cover 170 only encloses a portion of the seat frame 102 disposed above the support member 180 when the second end 172 of the cover 170 is in the second position. In some embodiments, the second end 172 of the cover 170 can include a fastener, such as a draw string, that is configured to close the second opening or securely fasten the second end 172 of the cover 170 about the collapsed seat frame 102.

When the second end 172 of the cover 170 is in the second position, the cover 170 limits or restricts the movement of the elongate members 110, 120, 130, and 140. In this manner, the cover 170 prohibits the seat frame 102 from moving from the collapsed configuration to the expanded configuration when the second end 172 of the cover 170 is in the second position. Additionally. the cover 102 protects the chair 100 from damage during storage and/or transportation when the second end 172 of the cover 102 is in the second position. Moreover, the cover 170 protects the user from being injured by the protruding elongate members 110, 120, 130 and/or 104 during transportation of the seat frame 102. In some embodiments, the cover 102 can include a tension member, such as a strap (not shown), that can be placed over the user's shoulder to transport the chair 100 when in the chair 100 is in the collapsed configuration.

In use, the user can transport the chair 100 illustrated in FIG. 2 to a desired location, such as a beach. When the user wants to use the chair 100, the user can move the second end 172 of the cover 170 over the collapsed chair 100 in a downward direction opposite to direction AA. More particularly, the user moves the second end 172 of the cover 170 from the second position to the first position to allow the seat frame 102 to be expanded. Once the second end 172 of the cover 170 is disposed about the support member 180 proximate to the first end 171 of the cover 170, the seat frame 102 can move from the collapsed configuration to the expanded configuration. The user can apply an outward force to, for example, the second portion 112 of the first elongate member 110 and the second portion 132 of the third elongate member 130, to expand the seat frame 102. Said another way, the seat frame 102 is moved to the expanded configuration when a force moves one or more of the elongate members 110, 120, 130 and/or 140 in an outward direction away from the support member 180.

When the seat frame 102 is in the expanded configuration, each of the elongate members 110, 120, 130 and 140 are restricted from moving further in the outward direction. In some embodiments, the support member 180 can restrict the continued movement of one or more of the elongate members 110, 120, 130 and 140 via a stopper or other device that restricts movement. In other embodiments, the membranes 151, 154, 157 and 161 can effectively limit the movement of the elongate members 110, 120, 130 and 140. For example, the first membrane 151 can limit the movement of the second elongate member 120 relative to the fourth elongate member 140. More specifically, the first membrane 151 restricts the movement of the second elongate member 120 relative to the fourth elongate member 140 when the distance between the second portion 124 of the second elongate member 120 and the second portion 144 of the fourth elongate member 140 equals the length of the first membrane 151. When this distance occurs, the first membrane 151 becomes taut. The second membrane 154 can also limit the movement of the first elongate member 110 relative to the third elongate member 130 in a manner similar to the first membrane 151. Likewise, the third membrane 157 can similarly limit the movement of the first elongate member 110 relative to the second elongate member 120. The fourth membrane 161 can similarly limit the movement of each of the elongate members 110, 120, 130 and 140 relative to each other since the fourth membrane 161 is coupled to each of the elongate members 110, 120, 130 and 140.

When the seat frame 102 is in the expanded configuration, the elongate members 110, 120, 130 and 140 are positioned in a manner that allows them to support the weight of the user seated in the chair 100. More particularly, when the seat frame 102 is in the expanded configuration, the first end 112 of the first elongate member 110 and the first end 122 of the second elongate member 120 are disposed in the front portion F of the chair 100. At the same time, the second portion 114 of the first elongate member 110 and the second portion 124 of the second elongate member 120 are disposed in the back portion B of the chair 100. More specifically, when the seat frame 102 is in the expanded configuration, the second end 118 of the first elongate member 110 and the second end 128 of the second elongate member 120 are disposed in the back portion B of the chair 100. Similarly stated, when the seat frame 102 is in the expanded configuration, the first elongate member 110 and the second elongate member 120 are in an inclined position relative to the surface on which the chair 100 is disposed.

Conversely, the first end 132 of the third elongate member 130 and the first end 142 of the fourth elongate member 140 are disposed in the back portion B of the chair 100 when the seat frame 102 is in the expanded configuration. At the same time, the second portion 134 of the third elongate member 130 and the second portion 144 of the fourth elongate member are disposed in the front portion F of the chair 100. More specifically, when the seat frame 102 is in the expanded configuration, the second end 138 of the third elongate member 130 and the second end 148 of the fourth elongate member 140 are disposed in the front portion F of the chair 100. Similarly stated, when the seat frame 102 is in the expanded configuration, the third elongate member 130 and the fourth elongate member 140 are in an inclined position relative to the surface on which the chair 100 is disposed. Accordingly, the first elongate member 110 and the fourth elongate member 140 are inclinedly positioned such that an inclined X-shaped cross construction is formed. Similarly, the second elongate member 120 and the third elongate member 130 are inclinedly positioned such that another inclined X-shaped cross construction is formed. The inclined X-shaped cross constructions enable the weight of the user seated in the chair 100 to be more evenly supported and balanced by the seat frame 102.

When the user is finished using the chair 100, the user can move the seat frame 102 from the expanded configuration to the collapsed configuration by exerting an inward force on one or more of the elongate members 110, 120, 130 and 140. Said another way, the seat frame 102 can be moved to the collapsed configuration by moving the elongate members 110, 120, 130 and 140 inward toward the support member 180. When the seat frame 102 is in the collapsed configuration, the elongate members 110, 120, 130 and 140 are in a substantially vertical position and the second portion 172 of the cover 170 can be moved from the first position to the second position, as described above. The process described herein can be continuously repeated.

In some embodiments, seat frame 102 can be a self-supporting structure. More specifically, when the seat frame 102 is in the expanded configuration, the support member 180 includes a stopping member configured to restrict further expansion of each of the elongate members 110, 120, 130 and 140. In addition, the weight of the components of the seat frame 102 hold the seat frame 102 in its expanded configuration such that the seat frame 102 does not revert back to its collapsed configuration once it is restricted from expanding. As such, the seat frame 102 does not need the membranes 151, 154, 157 and/or 161 or the support member 180 to remain in its expanded configuration.

In some embodiments, the membranes 151, 154, 157 and 161 can be constructed of any suitable material, as discussed above. In the preferred embodiment, the membranes 151, 154, 157 and 161 are constructed of a substantially flexible material that can be folded when the chair 100 is in the collapsed configuration.

Figure 3:
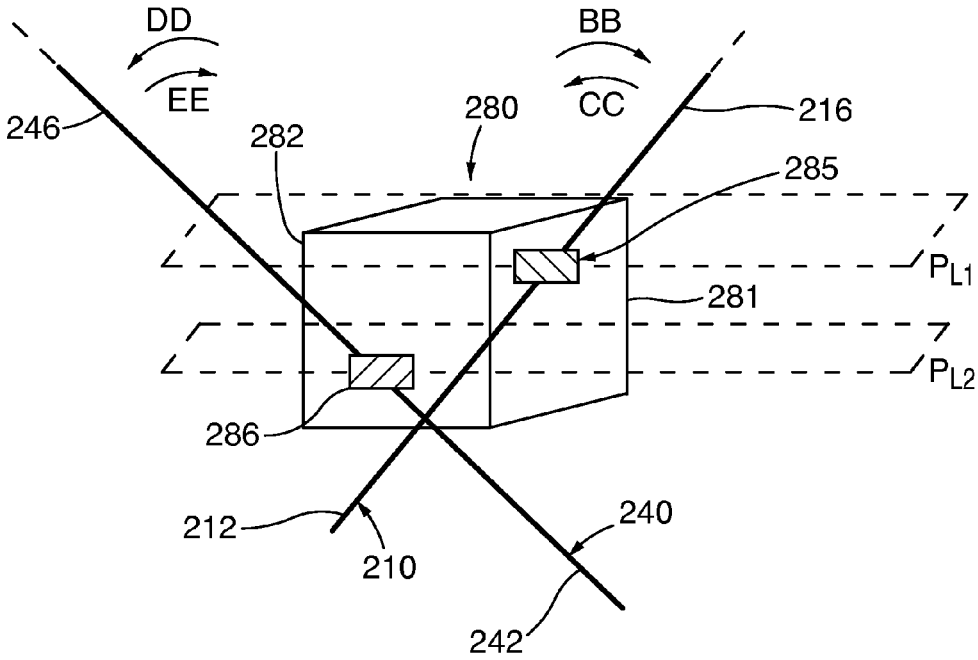
FIG. 3 is a schematic illustration of a support member according to an embodiment.

FIG. 3 is a schematic illustration of a support member 280 according to an embodiment. The support member 280 is a component of a seat frame for a collapsible chair having a similar structure and operation as the seat frame 102 of the collapsible chair 100. For example, the seat frame corresponding to the support member 280 is configured to move between an expanded configuration and a collapsed configuration in a manner similar to the seat frame 102 of the collapsible chair 100.

The support member 280 includes a first side 281 having a first planar surface and a second side 282 having a second planar surface substantially normal to the first planar surface. Said another way, the first side 281 is substantially normal to the second side 282 of the support member 280. As shown in FIG. 3, the support member 280 is cube-shaped and, therefore, has six planar surfaces or sides. For the purposes of simplicity, only the first side 281 and the second side 282 of the support member 280 will be referred to herein unless a particular side (other than the first side 280 or the second side 282) is referred to specifically. It should be understood that the side opposite the first side 281 (i.e., the side substantially parallel to the first side 281) has the same structure and operation as the first side 281. Similarly, the side opposite the second side 282 (i.e., the side substantially parallel to the second side 282) has the same structure and operation as the second side 282. Therefore, it is only necessary to describe the first side 281 and the second side 282.

The first side 281 of the support member 280 is coupled to a first portion 216 of a first elongate member 210 via a first coupling member 285. The first elongate member 210 has substantially the same structure and operation as the first elongate member 110 and, therefore, is not described in detail herein. The first coupling member 285, which can be, for example, a double-end bolt, is configured to extend through the support member 280 along a first horizontal plane $P_{L1}$ such that the first coupling member 285 can couple another elongate member (e.g., the second elongate member 120) to the support member 280. Said another way, the first coupling member 285 has a first end portion that extends from the first side 281 of the support member 280 and a second end portion that extends from a side opposite the first side 281 of the support member 280. The first end portion of the first coupling member 285 is configured to couple the first elongate member 210 to the support member 280 while the second end portion of the first coupling member 285 is configured to couple another elongate member (e.g., the second elongate member 120) to the support member 280 opposite the first elongate member 210. It should be understood that the other elongate member coupled to the second end portion of the first coupling member 285 operates in a manner similar to the first elongate member 210 such that any description related to the operation of the first elongate member 210 also applies to that other elongate member unless referred to specifically. The first coupling member 285 can be any suitable coupling member, such as, a dowel screw, stud, hanger bolt and/or the like. The coupling member 285 can have any suitable shape and/or size configured to couple the first elongate member 210 and/or another elongate member to the support member 280.

Similarly, the second side 282 of the support member 280 is coupled to a first portion 242 of a second elongate member 240 via a second coupling member 286. The second elongate member 240 has substantially the same structure and operation as the fourth elongate member 140 and, therefore, is not described in detail herein. The second coupling member 286, which can be, for example, another double-end bolt, is configured to extend through the support member 280 along a second horizontal plane $P_{L2}$ such that the second coupling member 286 can couple another elongate member (e.g., the third elongate member 130) to the support member 280. Said another way, the second coupling member 286 has a first end portion that extends from the second side 282 of the support member 280 and a second end portion that extends from a side opposite the second side 282 of the support member 280. The first end portion of the second coupling member 286 is configured to couple the second elongate member 240 to the support member 280 while the second end portion of the second coupling member 286 is configured to couple another elongate member (e.g., the third elongate member 130) to the support member 280 opposite the second elongate member 240. It should be understood that the other elongate member coupled to the second end portion of the second coupling member 286 operates in a manner similar to the second elongate member 240 such that any description related to the operation of the second elongate member 240 also applies to that other elongate member unless referred to specifically. The second coupling member 286 can be any suitable coupling member, such as, a dowel screw, stud, hanger bolt and/or the like. The second coupling member 286 can have any suitable shape and/or size configured to couple the second elongate member 240 and/or another elongate member to the support member 280.

As shown in FIG. 3 and discussed above, the first coupling member 285 extends through the support member 280 along the first horizontal plane $P_{L1}$ and the second coupling member 286 extends through the support member 280 along the second horizontal plane $P_{L2}$. The first coupling member 285 extends through the support member 280 in a side-to-side direction relative to the illustrated orientation of the support member 280. The second coupling member 286 extends through the support member 280 in a front-to-back direction relative to the illustrated orientation of the support member 280. In this manner, the first coupling member 285 has an orientation or alignment substantially normal to the orientation or alignment of the second coupling member 286.

The second horizontal plane $P_{L2}$, which is situated below the first horizontal plane $P_{L1}$, is substantially parallel to the first horizontal plane $P_{L1}$ such that the first coupling member 285 and the second coupling member 286 can each extend though the support member 280 without any interference from one another. If, for example, the first coupling member 285 and the second coupling member 286 were situated on the same horizontal plane (e.g., the first horizontal plane $P_{L1}$) the second coupling member 286 would be blocked from passing completely through the support member 280 by the first coupling member 285. In such an example where multiple coupling members are used on a common plane, one of the coupling members (e.g., the first coupling member 285) can be configured to extend through the support member 280. The other coupling member (e.g., the second coupling member 286) can be configured to extend through only a portion of the support member 280. As a result, a third coupling member (not shown) can be introduced to couple an elongate member (e.g., the third elongate member 130) opposite the second elongate member 240 to the support member 280. In short, utilizing multiple horizontal planes in such a situation minimizes the number of parts needed to construct the support member 280 and corresponding seat frame.

Although only two coupling members 285 and 286 were illustrated in FIG. 3 and described above, in other embodiments, any number of coupling members along any number of planes can be used to couple elongate members (e.g., elongate members 210 and 240) to the support member 280. Additionally, although the coupling members 285 and 286 were illustrated in FIG. 3 and described above as extending through the support member 280 along a first horizontal plane $P_{L1}$ and a second horizontal plane $P_{L2}$, respectively, in other embodiments, the coupling members 285 and 286 can extend through the support member 280 along respective vertical planes. In other embodiments, the coupling members 285 and 286 can extend through the support member 280 along any suitable plane that does not result an interference between the coupling members 285 and 286.

The support member 280 operates in a manner similar to the support member 180. For example, as described above with reference to the support member 180, the support member 280 provides a common location or hub where the elongate members 210 and 240 are operatively coupled together. Said another way, the support member 280 provides a centralized pivot point for the elongate members 210 and 240. Such a common location or hub also facilitates the movement of the corresponding seat frame between the expanded configuration and the collapsed configuration.

The elongate members 210 and 240 are pivotably connected to the support member 280 via the coupling members 285 and 286. In this manner, the elongate members 210 and 240 can rotate about the coupling members 285 and 286 relative to the support member 280. The rotation of the elongate members 210 and 240 results in the corresponding seat frame being moved between the expanded configuration and the collapsed configuration. As discussed above, the corresponding seat frame is in the collapsed configuration when the elongate members 210 and 240 are in a substantially vertical position relative to a surface upon which the chair is disposed. With respect to FIG. 3, the corresponding seat frame is in the collapsed configuration when a longitudinal axis (not shown) of the first elongate member 210 is substantially normal to the first horizontal plane $P_{L1}$ and a longitudinal axis (not shown) of the second elongate member 240 is substantially normal to the second horizontal plane $P_{L2}$.

The corresponding seat frame can be moved to the expanded configuration by rotating the first elongate member 210 in direction BB and rotating the second elongate member 240 in direction DD. When the corresponding seat frame is in the expanded configuration, the first elongate member 210 is restricted from moving farther in direction BB and the second elongate member 240 is restricted from moving farther in direction DD. For example, in some embodiments, the support member 280 and/or coupling members 285 and/or 286 can include a stopping mechanism that restricts the movement of the first elongate member 210 and the second elongate member 240. In other embodiments, one or more membranes of the chair can restrict the movement of the first elongate member 210 and the second elongate member 240, as described above with reference to membranes 151, 154, 157 and 161. It should be understood that while the first elongate member 210 rotates in the direction BB, the other elongate member disposed opposite the first side 281 rotates in the opposite direction. Similarly, while the second elongate member 240 rotates in the direction DD, the other elongate member disposed opposite the second side 282 rotates in the opposite direction. The corresponding seat frame can be moved back to the collapsed configuration by rotating the first elongate member 210 and the second elongate member 240 in the respective opposite directions. More specifically, the first elongate member 210 is rotated in direction CC, which is opposite the direction BB, and the second elongate member 240 is rotated in direction EE, which is opposite the direction DD.

In some embodiments, the support member 280 can be arranged within the corresponding seat frame such that the first elongate member 210 and the second elongate member 240 are disposed in a front portion of the corresponding chair and each support a portion of an armrests (e.g., formed by the first membrane 151 and/or the second membrane 154). Since the first elongate member 210 and the second elongate member 240 perform substantially the same function, the first elongate member 210 and the second elongate member 240 could have substantially the same structure. Similarly stated, a manufacturer could use the same type of elongate member structure for both the first elongate member 210 and the second elongate member 240. For example, the first elongate member 210 and the second elongate member 240 can have substantially the same size and/or shape. In using similar or identical elongate member structures in such a seat frame, the number of different types of parts used to construct the seat frame is reduced or minimized, which can potentially reduce the cost of manufacturing the chair.

In embodiments where the first elongate member 210 and the second elongate member 240 have the same length (i.e., size), a height variation between the first elongate member 210 and the second elongate member 240 can cause the chair to wobble when it is in the expanded configuration and disposed on a planar surface such as a hard floor. More specifically, the first elongate member 210 is coupled to the support member 280 in a different plane than the second elongate member 240. As a result of the plane location variation, the portion of the first elongate member 210 disposed below the support member 280 is shorter than the portion of the second elongate member 240 disposed below the support member 280. In short, the first elongate member 210 is slightly higher than the second elongate member 240.

Figure 4A:
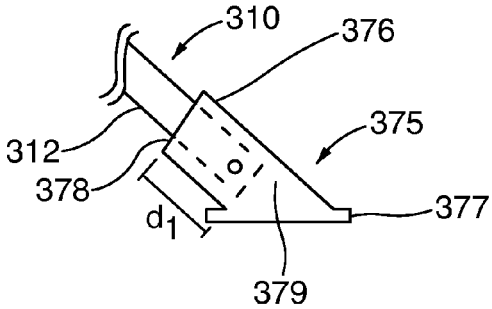
FIGS. 4A and 4B are schematic illustrations of a foot member according to an embodiment in a first configuration and a second configuration, respectively.
Figure 4B:
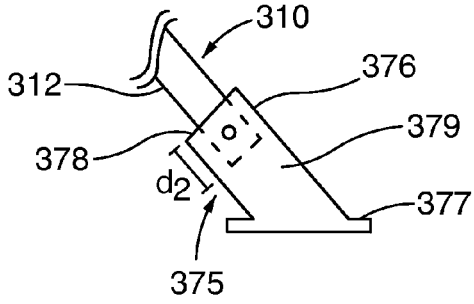
Figure 5:
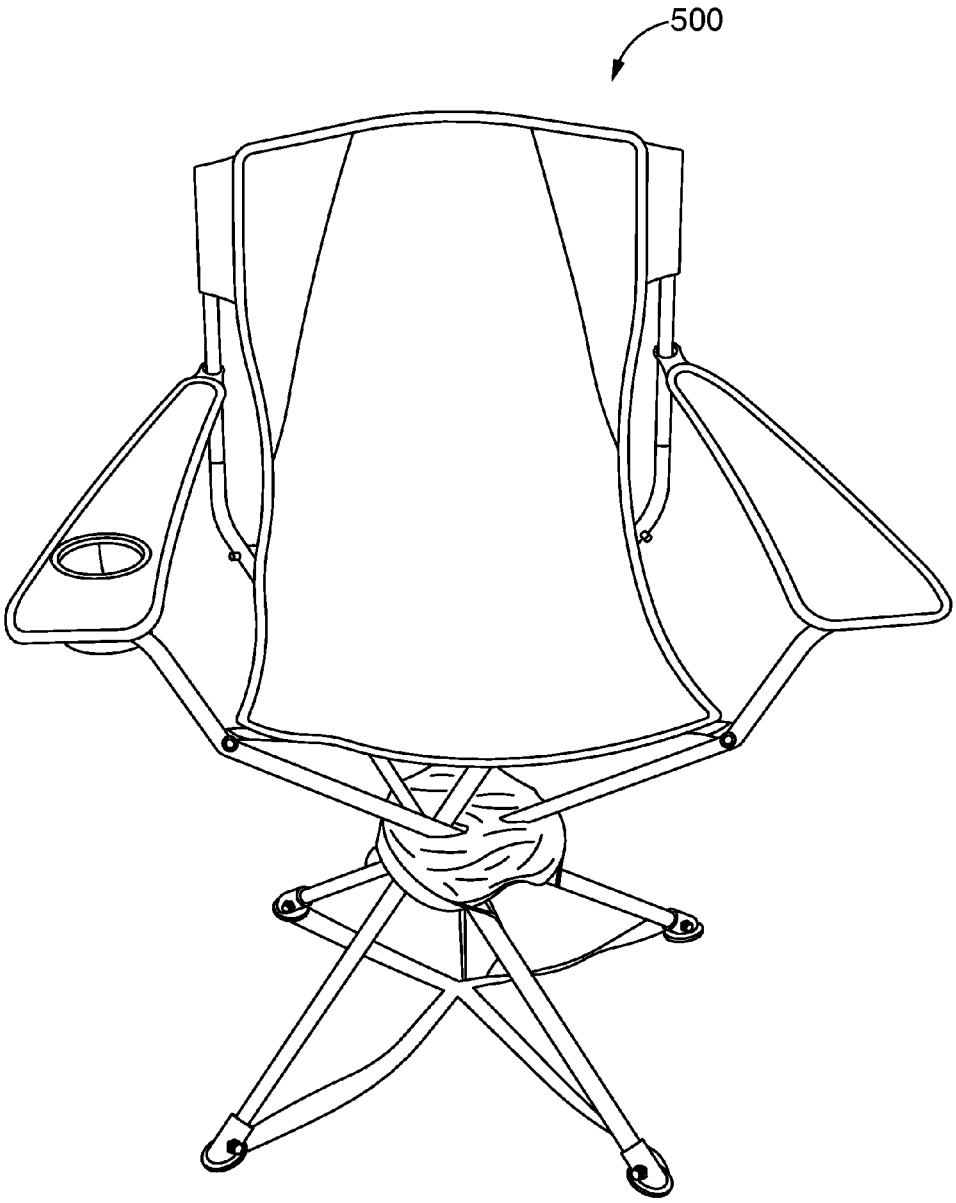
FIG. 5 is a front view of a collapsible chair in an expanded configuration according to an embodiment.
Figure 6:
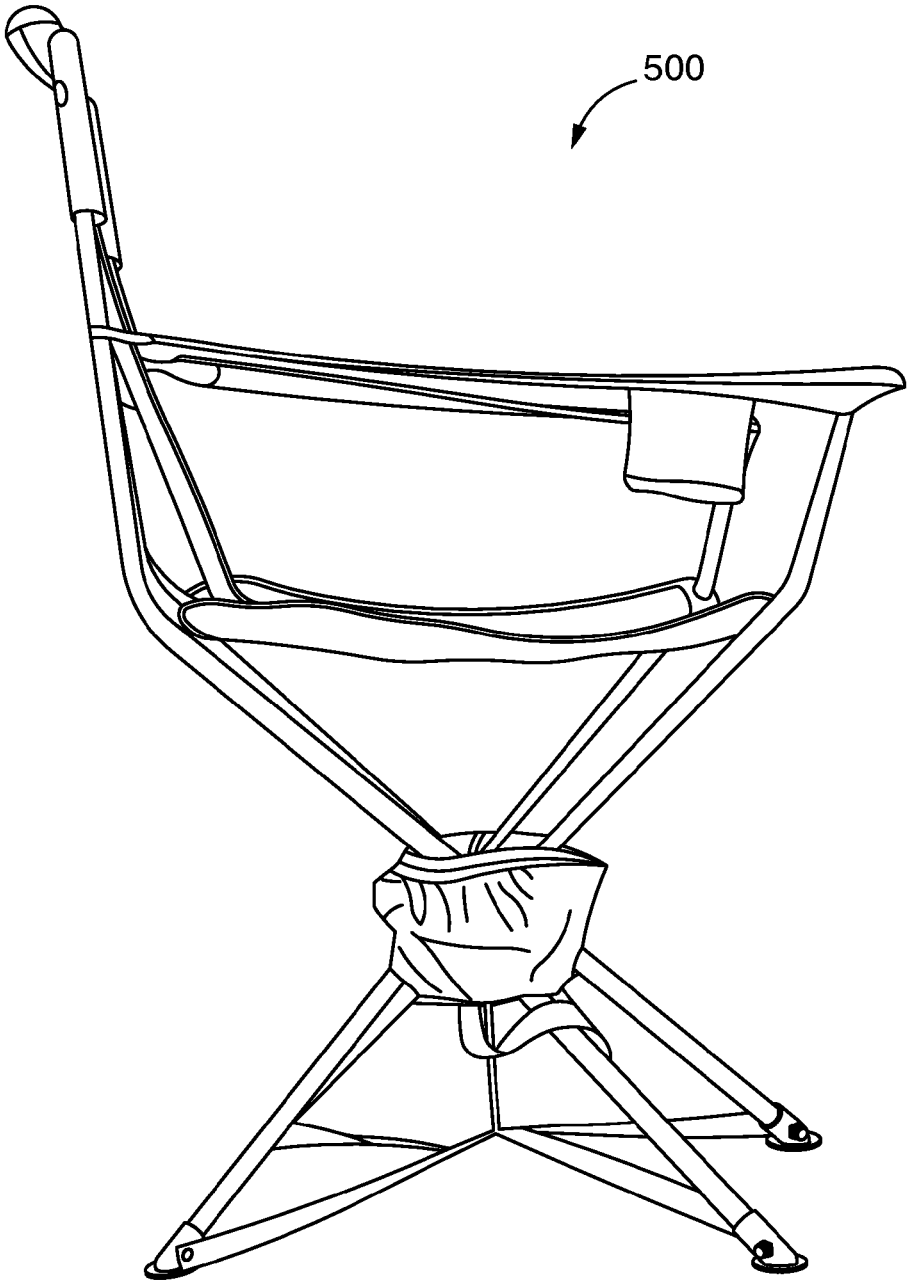
FIG. 6 is a side view of the collapsible chair illustrated in FIG. 5.
Figure 7:
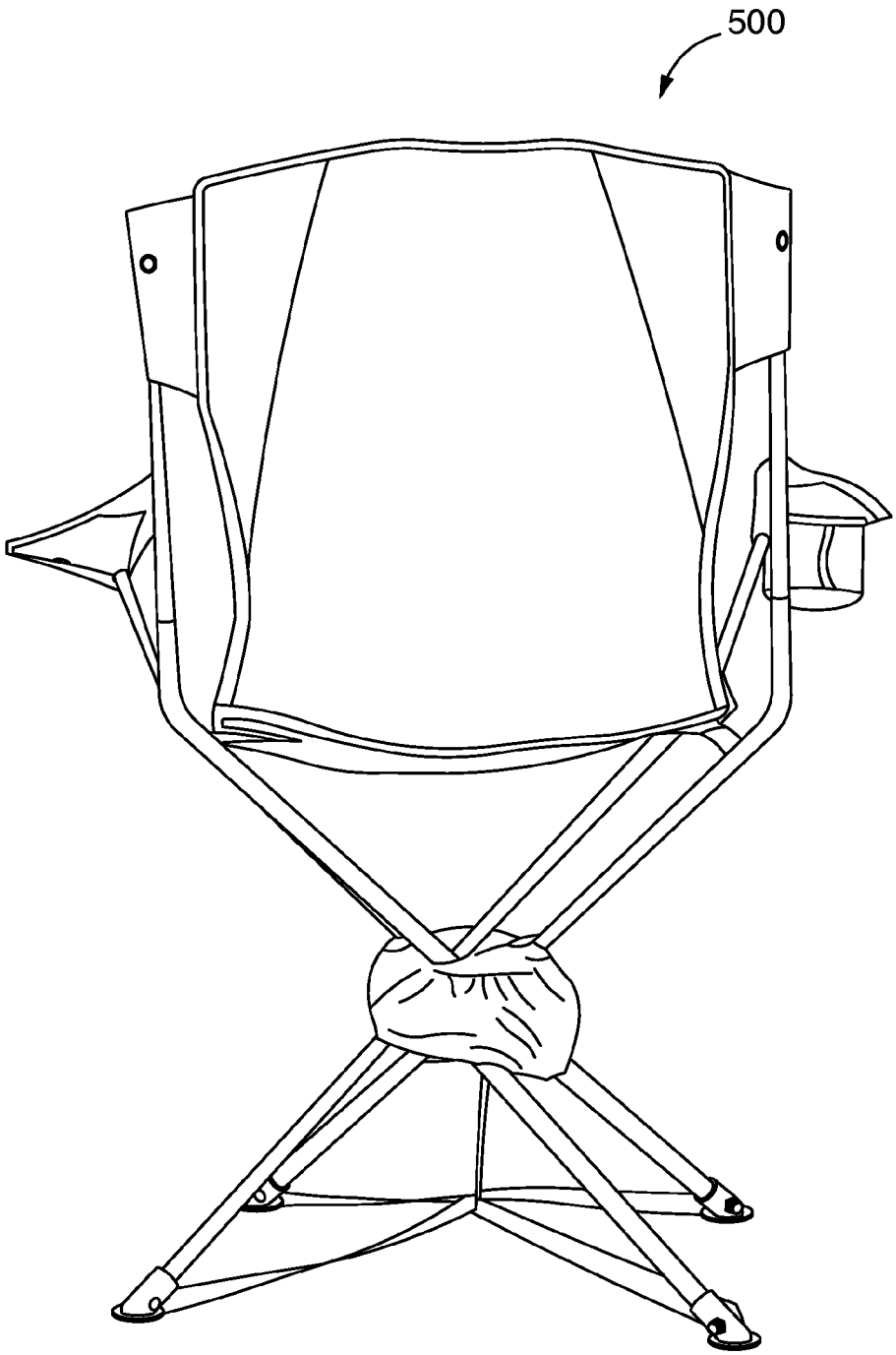
FIG. 7 is a rear view of the collapsible chair illustrated in FIG. 5.
Figure 8:
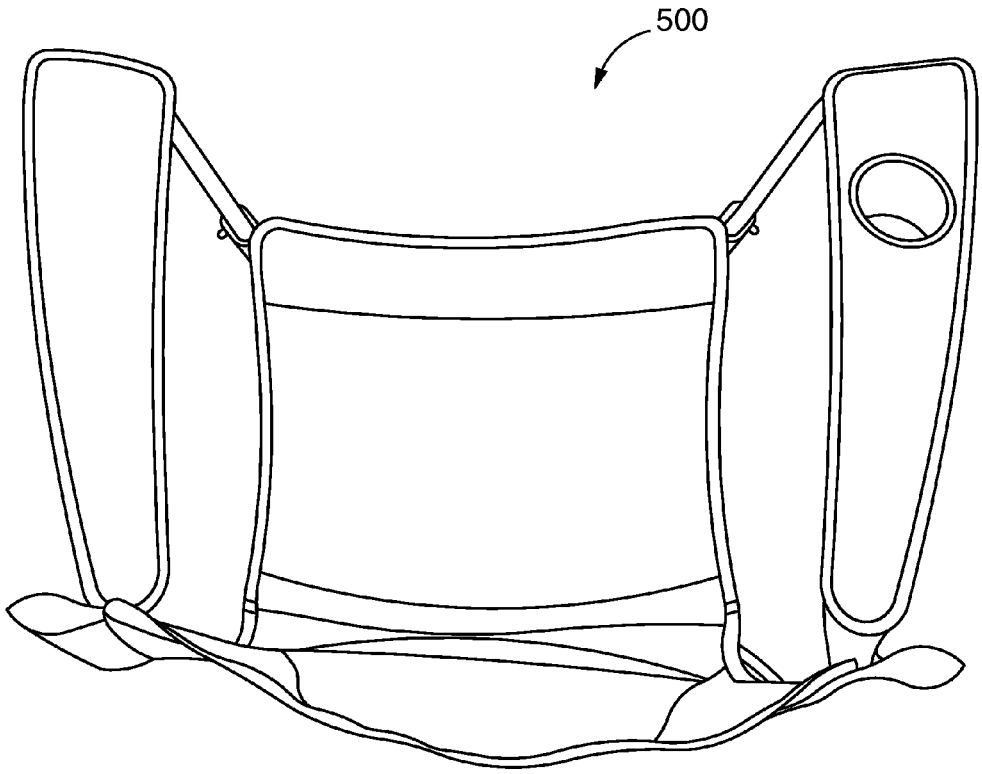
FIG. 8 is a top view of the collapsible chair illustrated in FIG. 5.
Figure 9:
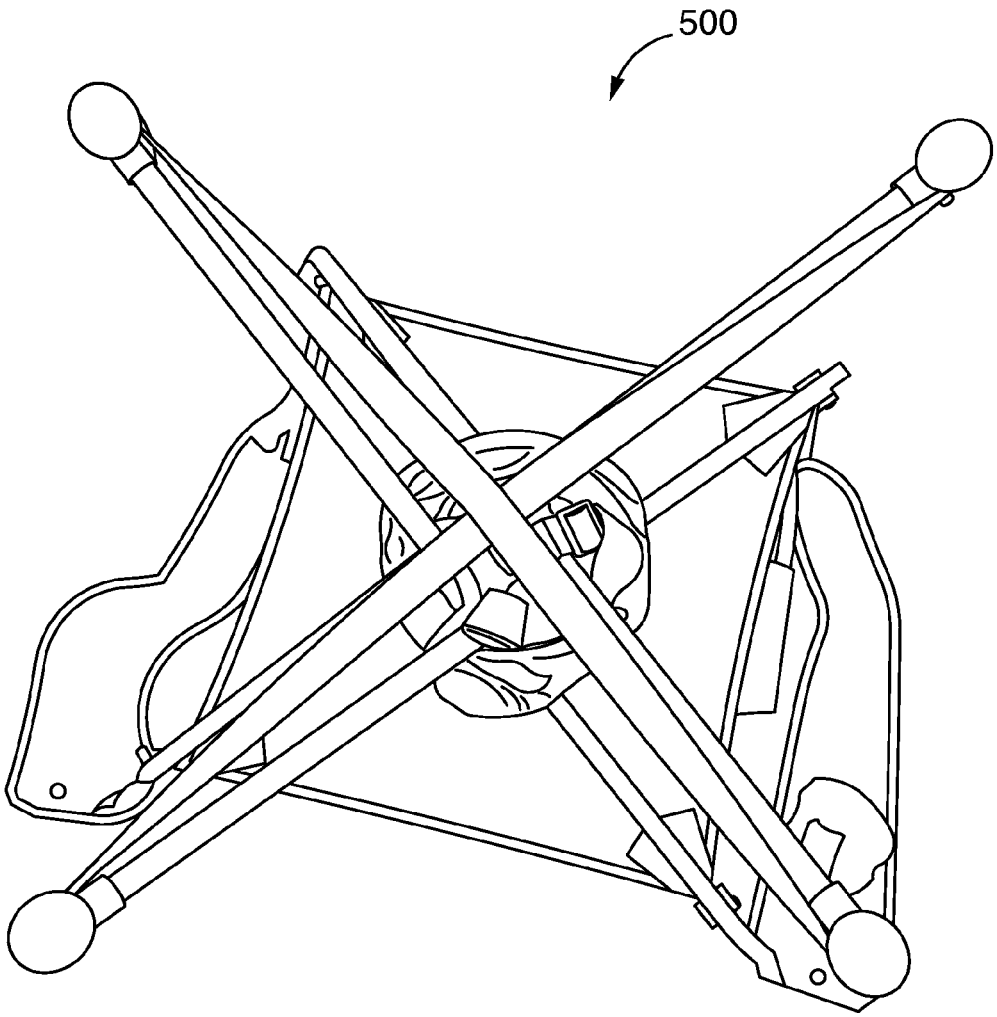
FIG. 9 is a bottom view of the collapsible chair illustrated in FIG. 5.

In some embodiments, feet members can be coupled to the distal-most ends of the elongate members 210 and 240 to offset the height variations caused by the plane variations. For example, FIGS. 4A and 4B are schematic illustrations of such a foot member 375 according to an embodiment in a first configuration and a second configuration, respectively. The foot member 375 includes a first end 376 and a second end 377 and defines a lumen 379. In some embodiments, the lumen 379 can extend through the entire length of the foot member 375. In other embodiments, the lumen 379 can be a blind hole such that the lumen 379 extends through only a portion of the foot member 375. The first end 376 of the foot member 375 defines an opening 378 configured to receive a distal-most end 312 of a first elongate member 310. The first elongate member 310 has substantially the same structure and operation as the first elongate member 210 and therefore is not described in detail herein. Although the opening 378 is illustrated and described as receiving the distal-most end 312 of the first elongate member 310, it should be understood that the opening 378 can be configured to receive any of the previously described elongate members (e.g., elongate members 110, 120, 130, 140, 210 and/or 240). The second end 377 of the foot member 375 has a substantially planar surface and is configured to contact a surface upon which a collapsible chair (e.g., chair 100) is disposed.

As shown in FIG. 4A, the foot member 375 is in the first configuration when the first elongate member 310 is disposed within the lumen 379 defined by the foot member 375 at a depth $d_1$. When the foot member 375 is in the first configuration, the first elongate member 310 is restricted from extending any deeper within the lumen 379. As shown in FIG. 4B, the foot member 375 is in the second configuration when the first elongate member 310 is disposed within the lumen 379 defined by the foot member 375 at a depth $d_2$. In this manner, the first elongate member 310 is disposed deeper within the lumen 379 when the foot member 375 is in the first configuration than when the foot member 375 is in the second configuration. Although the foot member 375 is illustrated and described as having a first configuration and a second configuration, in other embodiments, the foot member 375 can have any number of configurations such that the first elongate member 310 can be disposed within the lumen 379 at any depth.

The first elongate member 310 is configured to be coupled to the foot member 375 such that the first elongate member 310 remains within the lumen 379 at one of depth $d_1$ or $d_2$. In some embodiments, the first elongate member 310 can be coupled within the lumen 379 via an interference fit. The first elongate member 310, however, can be coupled to the foot member 375 by any suitable means. For example, the first elongate member 310 and the foot member 375 can be coupled together by a mechanical coupling (e.g., detents, a threaded coupling, or the like), an electronic coupling (e.g., a magnetic coupling), a chemical bond, a hydraulic coupling and/or a pneumatic coupling (e.g., a vacuum coupling). In some embodiments, however, the first elongate member 310 and the foot member 375 can be monolithically constructed.

As discussed above, the foot member 375 can be used to offset any height variations between elongate members that may result, for example, from being coupled to a support member (e.g., support member 280) within different planes. For example, in instances where an elongate member (e.g., the first elongate member 210) is shorter than a corresponding elongate member (e.g., the second elongate member 240), the shorter elongate member can use the foot member 375 to offset the height difference between the two elongate members. More specifically, the shorter elongate member can be disposed and coupled within the lumen 379 at a depth substantially equal to the height difference between the two elongate members. In embodiments where each of the elongate members are coupled to a foot member, the short elongate member could be disposed and coupled within a lumen of the corresponding foot member in the manner shown in FIG. 4B. The longer elongate member could be disposed and coupled within a lumen of the corresponding foot member in the manner shown in FIG. 4A.

Figure 10:
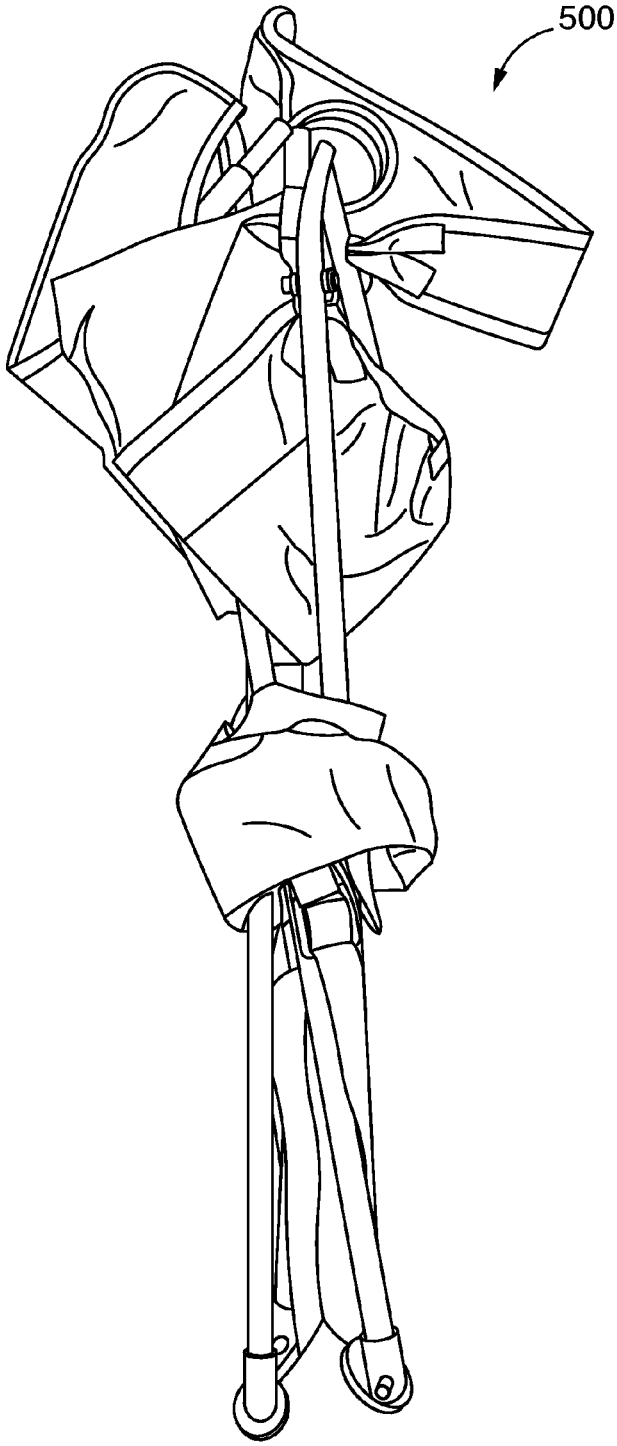
FIG. 10 is a front view of the collapsible chair illustrated in FIG. 5 in a collapsed configuration.
Figure 11:
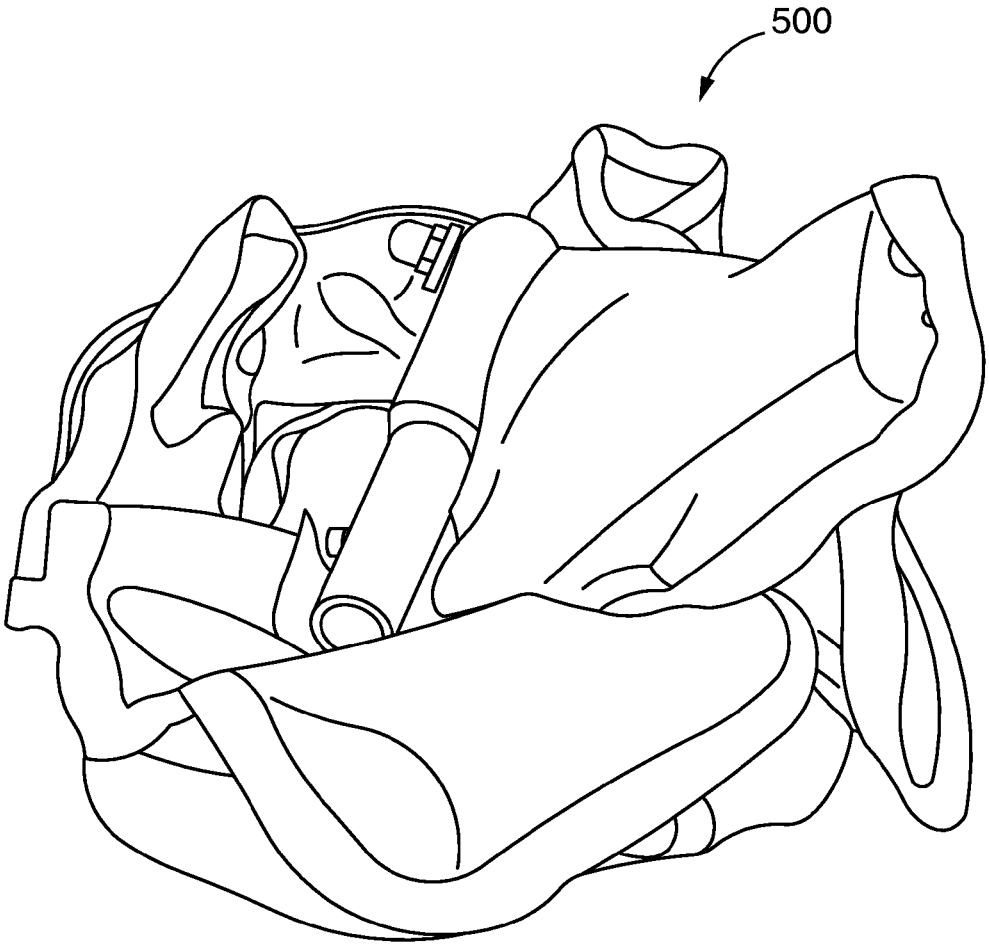
FIG. 11 is a top view of the collapsible chair illustrated in FIG. 10.
Figure 12:
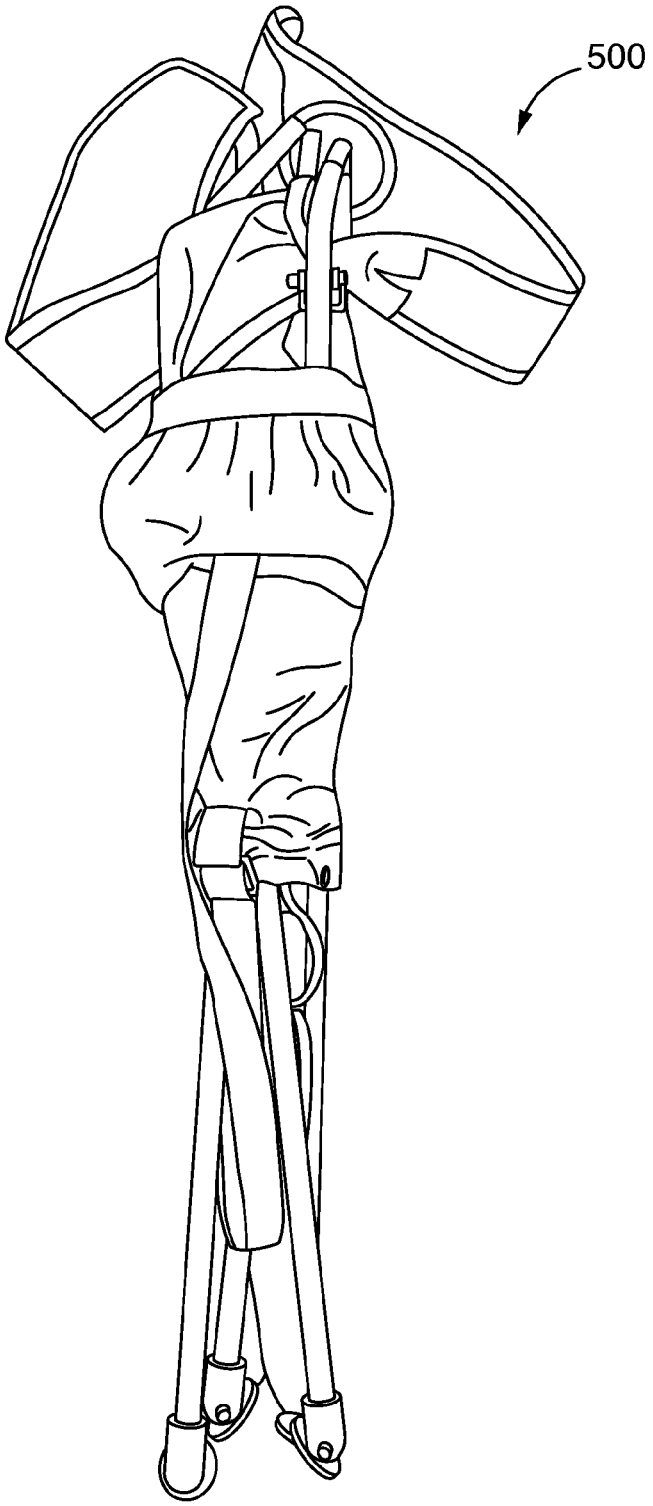
FIG. 12 is a side view of the collapsible chair illustrated in FIG. 10 with a portion of the chair being enclosed by a cover.
Figure 13:
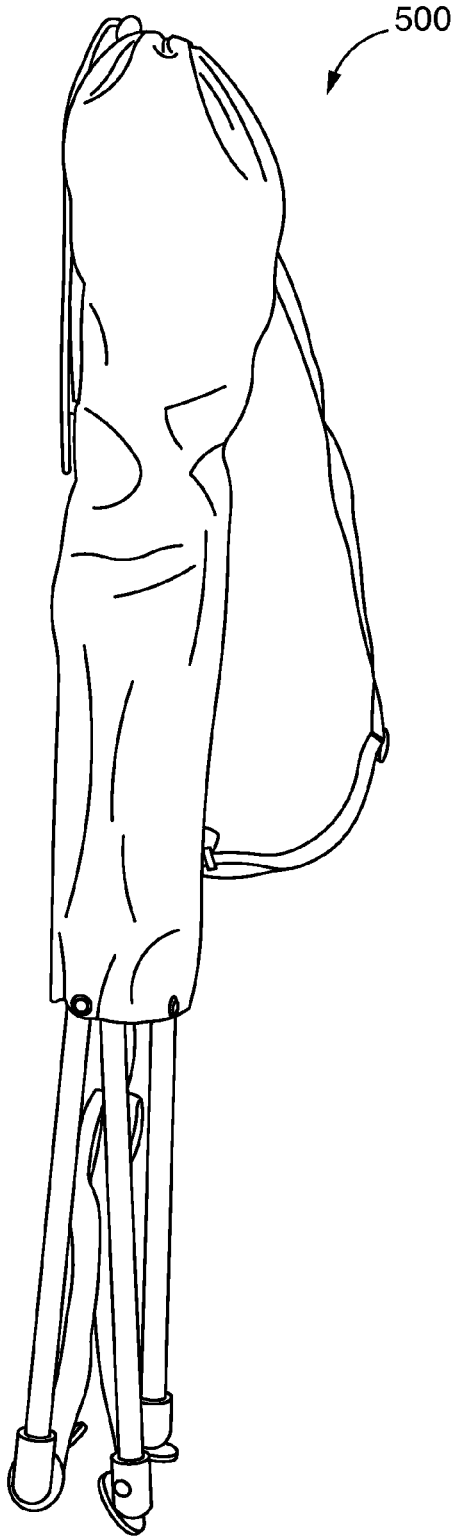
FIG. 13 is a is a side view of the collapsible chair illustrated in FIG. 10 with a top portion of the chair being entirely enclosed by the cover.
Figure 14:
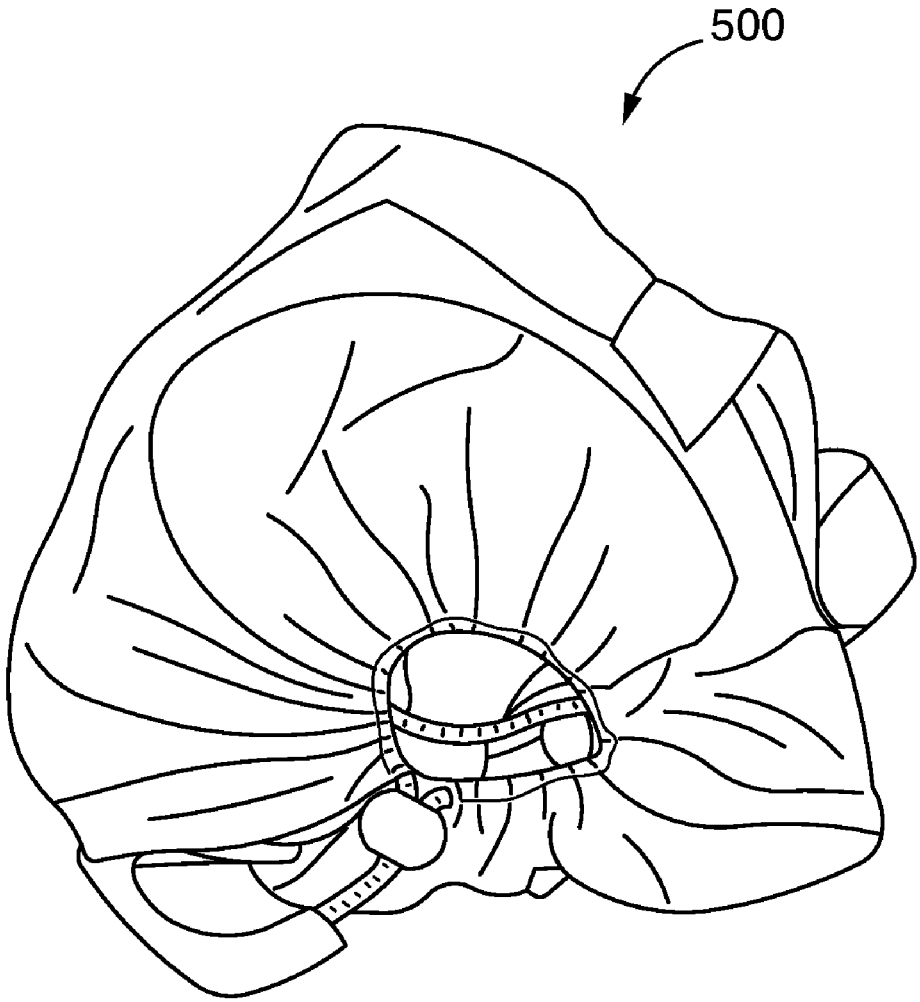
FIG. 14 is a top view of the collapsible chair illustrated in FIG. 13.
Figure 15:
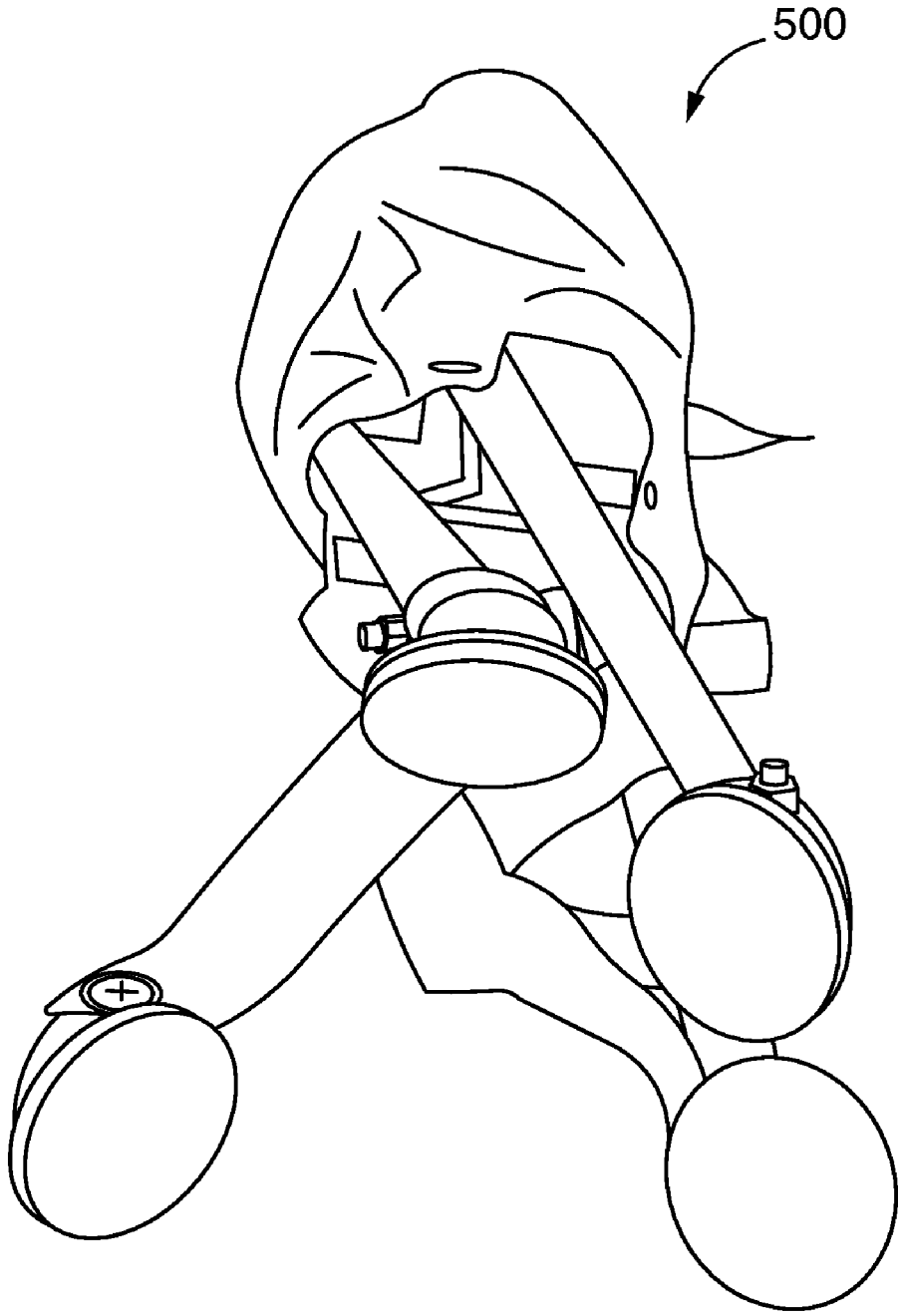
FIG. 15 is a bottom view of the collapsible chair illustrated in FIG. 13.

FIGS. 5-9 are perspective views of a collapsible chair 500 in an expanded configuration, where the views are from the front, side, rear, top and bottom, respectively. FIGS. 10 and 11 are perspective views of the collapsible chair 500 in a collapsed configuration, where the views are from the front and from the top, respectively. FIG. 12 is a side view of the collapsible chair 500 with a portion of the chair 500 being enclosed by a cover. Additionally, FIGS. 13-15 are perspective views of the collapsible chair 500 in the collapsed configuration with a top portion of the chair being entirely enclosed by the cover, where the views are from the front, top and bottom, respectively. The chair 500 has substantially the same structure and operation as the chair 100. The chair 500 can include any of the components and/or limitations discussed herein.

Figure 16:
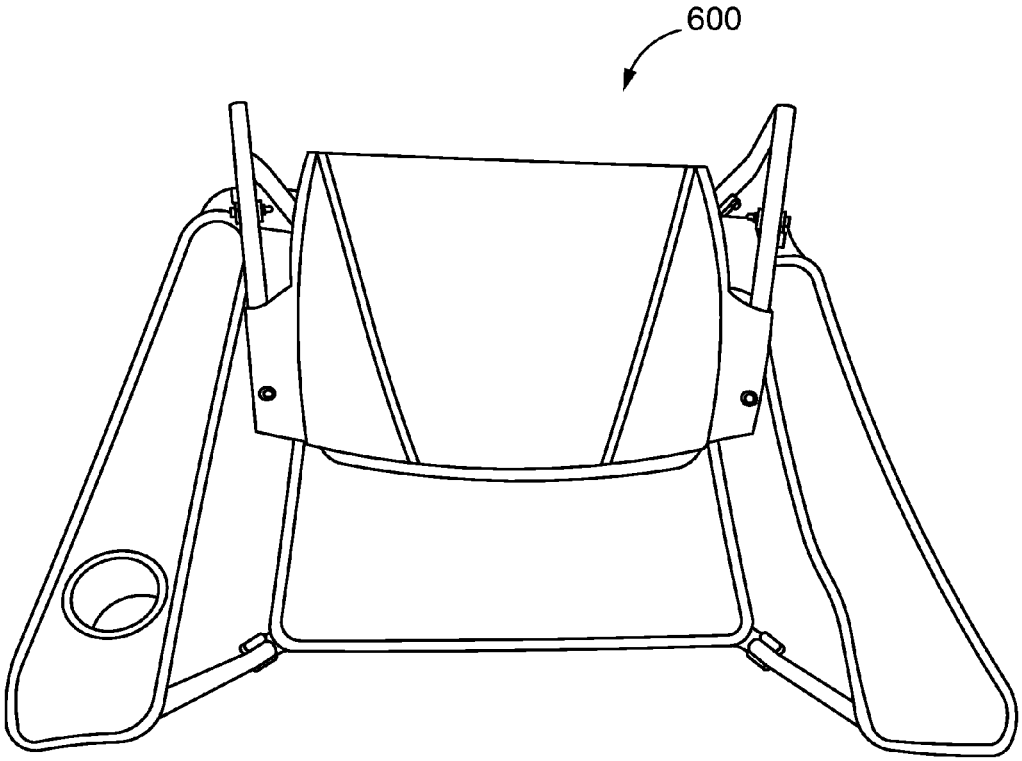
FIG. 16 is a top view of a collapsible chair in a partially collapsed configuration.
Figure 17:
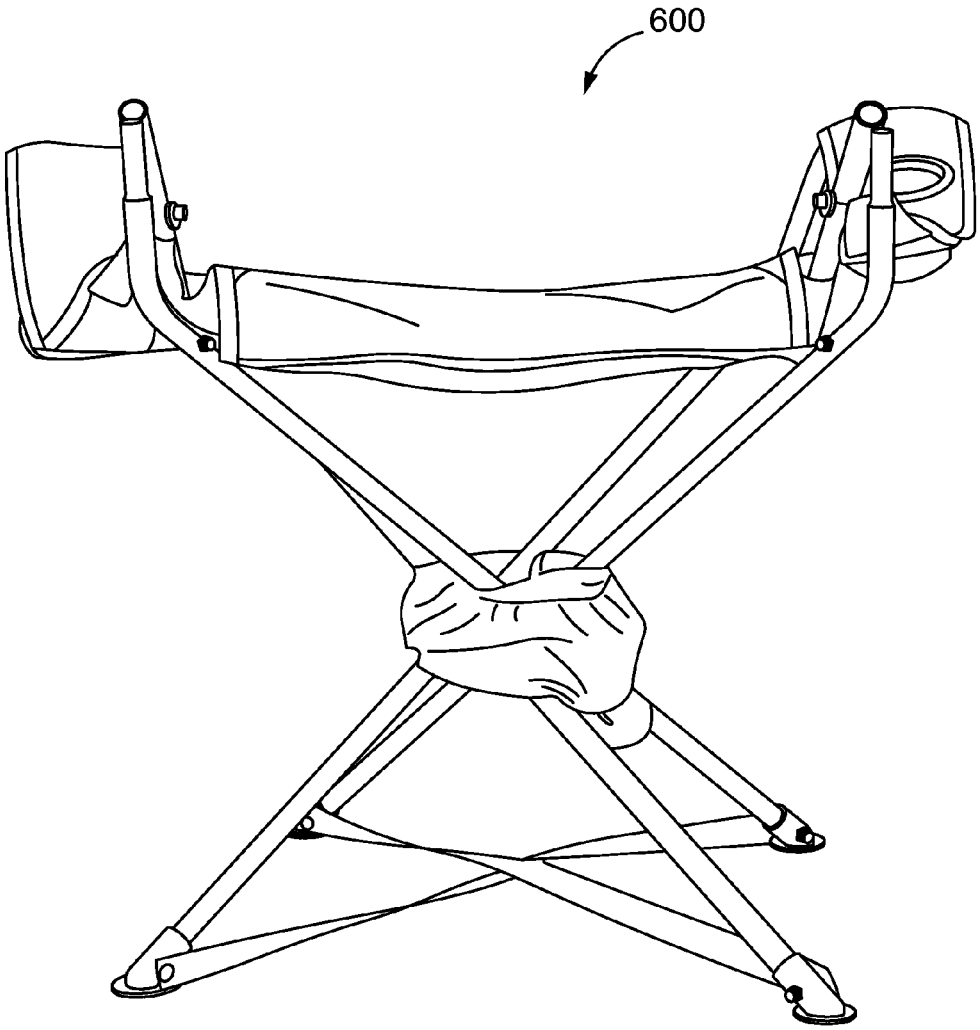
FIG. 17 is a back view of the collapsible chair illustrated in FIG. 16.
Figure 18:
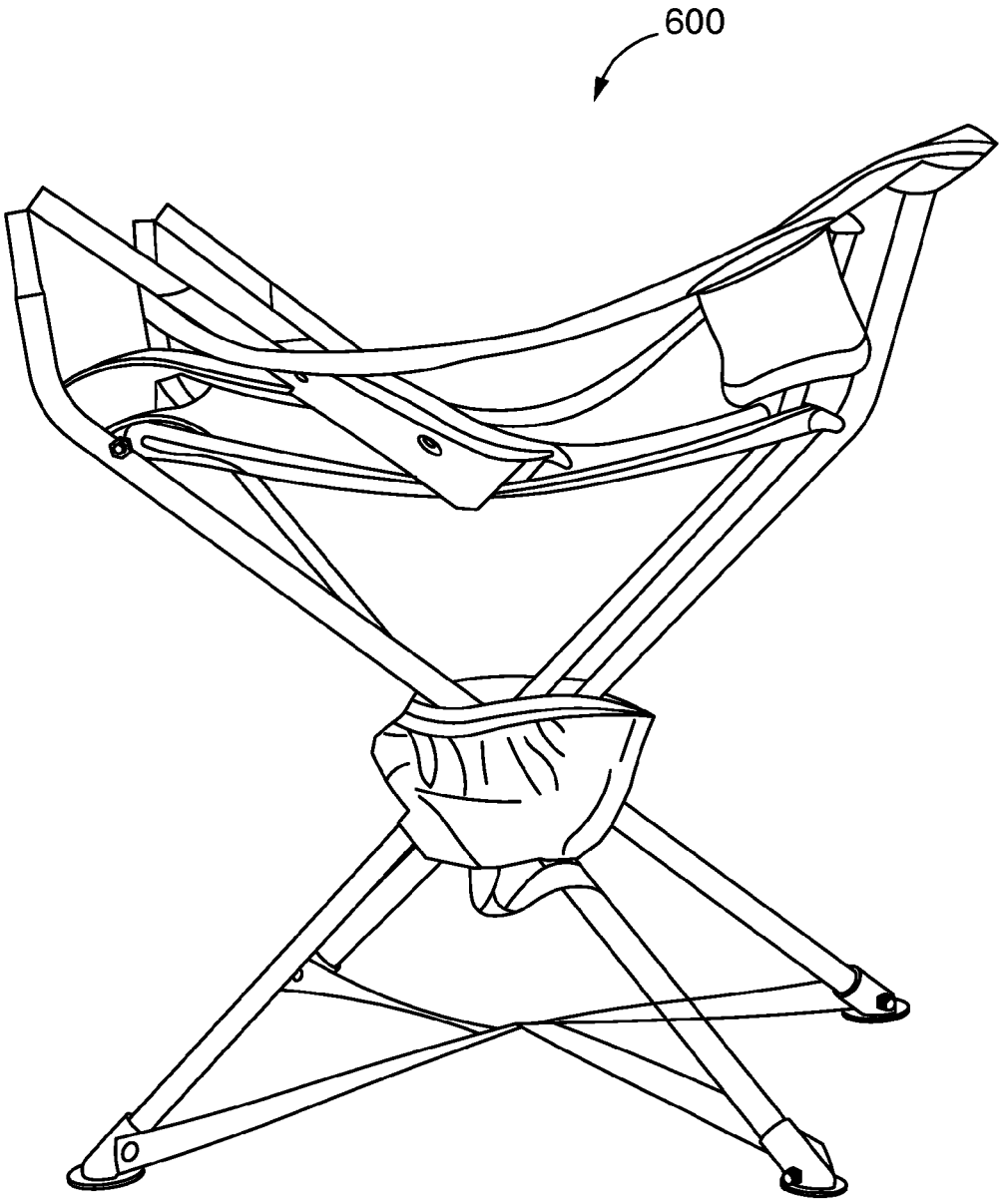
FIG. 18 is a side view of the collapsible chair illustrated in FIG. 16.

Additionally, FIGS. 16-18 are perspective views of a collapsible chair 600 in a partially collapsed configuration, where the views are from the top, rear, and side, respectively. The chair 600 has substantially the same structure and operation as the chair 100 but differs with respect to the structure and operation of the second portions 124 and 114 of the second elongate member 120 and the first elongate member 110, respectively, as described in more detail herein. The chair 600 can include any of the components and/or limitations discussed herein.

While various embodiments of the invention have been described above, it should be understood that they have been presented by way of example only, and not limitation. Where methods or other types of movement described above indicate certain events occurring in certain order, the ordering of certain events may be modified. Additionally, certain of the events may be performed concurrently in a parallel process when possible, as well as performed sequentially as described above.

Although the seat frames have been illustrated and described above as being a frame for a collapsible chair, it should be understood that the seat frames can be a frame for any structure that includes a seat. For example, the seat frames illustrated and described above can be used as a frame in conjunction with a stool, a couch, a high chair and/or the like.

In some embodiments, the chair can include a canopy or shade. The canopy or shade can be coupled to any portion of the seat frame capable of supporting the structure of the canopy or shade.

In some embodiments, one or more of the membranes can include a storage device. For example, one or more of the membranes can include a pocket, a mesh compartment, a cooler compartment and/or the like. In some embodiments, one or more of the membranes can include a cushion, such as, for example, a pillow.

In some embodiments, one or more of the elongate members can include wheels. For example, a wheel could be rotatably mounted on one or move of the elongate members such that the chair can easily be moved between locations when it is in the expanded configuration.

In some embodiments, the second portion of one or more of the elongate members that form a portion of a backrest can include a removable portion that is configured to move between a first position and a second position. For example, the second portion 124 of the second elongate member 120 can include such a removable portion. The removable portion can be coupled to the second portion 124 of the second elongate member 120 in any suitable manner, such as for example, by a bolted joint connection, by a snap ring, by a threaded coupling, by an interference fit and/or the like.

When the removable portion is in the first position, the removable portion is coupled to the second portion 124 of the second elongate member 120. When the removable portion is in the second position, the removable portion is disposed apart from the second portion 124 of the second elongate member 120. In this manner, the chair 102 can form a smaller side-to-side size or diameter when in the collapsed configuration. In embodiments where a portion of the second elongate member 120 is hollow, a tension member or cord can be disposed within the removable portion and the second portion 124 such that the removable portion can removed from direct contact with the second portion 124, but remains connected to the second elongate member 120 (shown in FIGS. 16-18).

In some embodiments, the second portion of one or more of the elongate members has an extended position and a contracted position. For example, the second portion 124 of the second elongate member 120 can include a first linkage that is slideably coupled to a second linkage of the second portion 124. The first linkage can be sized such that it slides within a cavity of the second linkage. This "telescoping" arrangement between the first linkage and the second linkage allows the second portion 124 to be placed in an extended, or lengthened, position and in a contracted, or shortened, position. When in the extended, or lengthened, position, the telescoping arrangement allows the seat frame 102 to fully extend to the intended height. When in the contracted, or shortened position, the telescoping arrangement allows for compact transportation of the seat frame 102.

It should, of course, be understood that while particular component shapes and configurations have been described, other component shapes and configurations are possible. For example, although the support member 280 is shown and discussed as having a cubic shape, the support member 280 can have a more rectangular shape with rounded corners or any other suitable cuboid shape. In some embodiments, the support member 280 can have a spherical shape.

What is claimed is:

1. An apparatus, comprising:

a seat frame having an expanded configuration and a collapsed configuration, the seat frame including:

a support member;

a first elongate member of a first pole type defined by a length and a shape;

a second elongate member of a second pole type defined by a length and a shape, the first elongate member and the second elongate member each being pivotably connected to the support member, the first elongate member and the second elongate member each having a first end disposed at a front portion of the seat frame and each having a second end disposed at a back portion of the seat frame when the seat frame is in the expanded configuration; and a third elongate member and a fourth elongate member each of a third pole type defined by a length and a shape, the third pole type being different from the first pole type, the third elongate member and the fourth elongate member each being pivotably connected to the support member, the third elongate member and the fourth elongate member each having a first end disposed at the back portion of the frame and each having a second end disposed at the front portion of the frame when the frame is in the expanded configuration.

2. The apparatus of claim 1, wherein the support member maintains a constant position relative to the first, second, third and fourth elongate members when the seat frame is moved between the expanded configuration and the collapsed configuration.

3. The apparatus of claim 1, wherein a first end of the first elongate member is configured to be slidably received within a lumen of a foot member configured to contact the ground, the first end of the first elongate member being disposed within the lumen at a depth sufficient to offset a height variation between the elongate members when the seat frame is in the expanded configuration.

4. The apparatus of claim 1, wherein the first pole type is substantially the same as the second pole type.

5. The apparatus of claim 1, wherein the first end of the first elongate member is coupled to a first foot member configured to contact the ground and the first end of the second elongate member is coupled to a second foot member configured to contact the ground, the first end of the first elongate member being disposed within a lumen defined by the first foot member at a first depth and the first end of the second elongate member being disposed within a lumen defined by the second foot member at a second depth different from the first depth.

6. The apparatus of claim 1, wherein the seat frame is one of a chair frame, a stool frame, or a couch frame.

7. The apparatus of claim 1, wherein the third elongate member includes a telescoping portion configured to move the third elongate member between a shortened configuration and a lengthened configuration.

8. An apparatus, comprising:

a seat frame having an expanded configuration and a collapsed configuration, the seat frame including:

a support member;

a first elongate member and a second elongate member each being pivotably coupled to an outer surface of the support member, the first elongate member and the second elongate member each having a first end disposed at a front portion of the seat frame and each having a second end disposed at a back portion of the seat frame when the seat frame is in the expanded configuration; and a membrane having a first portion, and a second portion moveable between a first position and a second position, the second portion configured to be disposed about at least a portion of the support member when the seat frame is in the expanded configuration and the second portion is in the first position, the second portion configured to retain at least a portion of the seat frame when the seat frame is in the collapsed configuration and the second portion is in the second position.

9. The apparatus of claim 8, wherein the membrane defines an opening through which the seat frame extends.

10. The apparatus of claim 8, wherein the second portion of the membrane is at least one of disposed about the support member or fixedly coupled to the support member.

11. The apparatus of claim 8, wherein the third elongate member and the fourth elongate member define a back support member configured to be retained by the second portion of the membrane when the seat frame is in the collapsed configuration.

12. The apparatus of claim 8, wherein the first elongate member and the second elongate member are pivotably coupled to the support member along a first horizontal plane via a first coupling member, and the third elongate member and the fourth elongate member are pivotable coupled to the support member along a second horizontal plane via a second coupling member.

13. The apparatus of claim 8, wherein the support member maintains a constant position relative to the first, second, third and fourth elongate members when the seat frame is moved between the expanded configuration and the collapsed configuration.

14. The apparatus of claim 8, wherein a third elongate member and a fourth elongate member each being pivotably coupled to the support member, the third elongate member and the fourth elongate member each having a first end disposed at the back portion of the frame and each having a second end disposed at the front portion of the frame when the frame is in the expanded configuration.

15. The apparatus of claim 8, wherein the seat frame is one of a chair frame, a stool frame, or a couch frame.

16. An apparatus, comprising:

a seat frame having an expanded configuration and a collapsed configuration, the seat frame including:

a support member;

a first elongate member and a second elongate member each being pivotably coupled to the support member, the first elongate member and the second elongate member each having a first portion disposed at a front portion of the seat frame and each having a second portion disposed at a back portion of the seat frame when the seat frame is in the expanded configuration; and a third elongate member and a fourth elongate member each being pivotably coupled to the support member, the third elongate member and the fourth elongate member each having a first portion disposed at the back portion of the frame and each having a second portion disposed at the front portion of the frame when the frame is in the expanded configuration;

a first membrane coupled to the second portion of the first elongate member and the second portion of the third elongate member to define a first arm support; and a second membrane coupled to the second portion of the second elongate member and the second portion of the fourth elongate member to define a second arm support.

17. The apparatus of claim 16, wherein the support member maintains a constant position relative to the first, second, third and fourth elongate members when the seat frame is moved between the expanded configuration and the collapsed configuration.

18. The apparatus of claim 16, wherein the first membrane has a first portion coupled to the second portion of the first elongate member and a second portion coupled to the second portion of the third elongate member.

19. The apparatus of claim 16, wherein the second membrane has a first portion coupled to the second portion of the second elongate member and a second portion coupled to the second portion of the fourth elongate member.

20. The apparatus of claim 16, further including a third membrane coupled to the second portion of the first elongate member and the second portion of the second elongate member to form a back support member, the third membrane configured to limit the horizontal expansion of the seat frame when the seat frame is in the expanded configuration.

21. The apparatus of claim 16, wherein the first elongate member and the second elongate member are pivotably coupled to the support member along a first horizontal plane via a first coupling member, and the third elongate member and the fourth elongate member are pivotable coupled to the support member along a second horizontal plane via a second coupling member.

22. The apparatus of claim 16, wherein the first membrane and the second membrane configured to limit an outward expansion of the seat frame when the seat frame is in the expanded configuration.

23. The apparatus of claim 8, wherein the support member includes a top surface, a bottom surface, and at least one side surface, the first elongate member and the second elongate member each being pivotably coupled to the at least one side surface of the support member.

* * * * *